US006456806B2

(12) United States Patent
Shoji et al.

(10) Patent No.: US 6,456,806 B2
(45) Date of Patent: Sep. 24, 2002

(54) DEVELOPING METHOD, DEVICE, AND IMAGE FORMING APPARATUS WITH MAGNET BRUSH

(75) Inventors: Hisashi Shoji; Tsukuru Kai, both of Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/852,212

(22) Filed: May 10, 2001

(30) Foreign Application Priority Data

May 15, 2000 (JP) ..... 2000-142343

(51) Int. Cl.[7] ..... G03A 15/09
(52) U.S. Cl. ..... 399/150; 399/277; 430/122
(58) Field of Search ..... 399/149, 150, 399/267, 277; 430/122

(56) References Cited

U.S. PATENT DOCUMENTS 5,075,729 A * 12/1991 Hayashi et al. ..... 399/150
5,196,891 A * 3/1993 Shimazaki et al. ..... 399/150
5,412,454 A * 5/1995 Masumi ..... 399/150
5,467,176 A * 11/1995 Watanuki et al. ..... 399/149
5,587,774 A * 12/1996 Nagahara et al. ..... 399/149
5,805,960 A * 9/1998 Suzuki et al. ..... 399/148
6,341,207 B1 * 1/2002 Sasaki et al. ..... 399/149

FOREIGN PATENT DOCUMENTS

| | | |
|---|---|---|
| JP | 7-084456 | 3/1995 |
| JP | 08-160725 | 6/1996 |
| JP | 09-236986 | 9/1997 |
| JP | 2000-305360 | 11/2000 |
| JP | 2000-315001 | 11/2000 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

A developing device for an image forming apparatus capable of collecting a developer left on an image carrier with a so-called cleanerless process is disclosed. A ratio of a distance between the image carrier and a developer carrier at the boundary of a nip to a development gap at the center of the nip is selected to be 1.5 or less. This obviates the omission of the trailing edge of an image and granularity and enhances faithful reproduction of horizontal lines and dots despite the use of the cleanerless process.

22 Claims, 22 Drawing Sheets

*Fig. 16*

| EXAMPLE 1 | | | | | | |
|---|---|---|---|---|---|---|
| POLE | P1 | P2 | P3 | P4 | P5 | P6 |
| POLARITY | N | S | S | S | N | S |
| PEAK FLUX DENSITY (mT) | 130 | 65 | 7 | 20 | 72 | 75 |
| CENTER HALF ANGLE (°) | 0 | 60 | 115 | 157 | 207 | 291 |
| CENTER HALF-POWER ANGLE | 18 | 40 | – | 35 | 34 | 29 |
| EXAMPLE 2 | | | | | | |
| POLE | P1 | P2 | P3 | P4 | P5 | P6 |
| POLARITY | N | S | S | S | N | S |
| PEAK FLUX DENSITY (mT) | 110 | 60 | 4 | 30 | 79 | 82 |
| CENTER HALF ANGLE (°) | 0 | 62 | 118 | 158 | 224 | 285 |
| CENTER HALF-POWER ANGLE | 20 | 30 | – | 30 | 47 | 41 |
| EXAMPLE 3 | | | | | | |
| POLE | P1 | P2 | P3 | P4 | P5 | P6 |
| POLARITY | N | S | S | S | N | S |
| PEAK FLUX DENSITY (mT) | 94 | 73 | 5 | 52 | 65 | 58 |
| CENTER HALF ANGLE (°) | 0 | 65 | 120 | 154 | 217 | 291 |
| CENTER HALF-POWER ANGLE | 30 | 46 | – | 35 | 55 | 40 |
| EXAMPLE 4 | | | | | | |
| POLE | P1 | P2 | P3 | P4 | P5 | P6 |
| POLARITY | N | S | S | S | N | S |
| PEAK FLUX DENSITY (mT) | 95 | 90 | 50 | 5 | 60 | 55 |
| CENTER HALF ANGLE (°) | 0 | 62 | 117 | 160 | 223 | 289 |
| CENTER HALF-POWER ANGLE | 37 | 47 | 42 | – | 45 | 59 |
| EXAMPLE 5 | | | | | | |
| POLE | P1 | P2 | P3 | P4 | | |
| POLARITY | N | S | N | S | | |
| PEAK FLUX DENSITY (mT) | 94 | 73 | 10 | 80 | | |
| CENTER HALF ANGLE (°) | 0 | 65 | – | 290 | | |
| CENTER HALF-POWER ANGLE | 25 | 46 | – | 55 | | |
| COMPARATIVE EXAMPLE 1 | | | | | | |
| POLE | P1 | P2 | P3 | P4 | P5 | P6 |
| POLARITY | N | S | S | S | N | S |
| PEAK FLUX DENSITY (mT) | 95 | 90 | 50 | 5 | 60 | 55 |
| CENTER HALF ANGLE (°) | 0 | 62 | 117 | 160 | 223 | 289 |
| CENTER HALF-POWER ANGLE | 46 | 47 | 35 | – | 37 | 55 |
| COMPARATIVE EXAMPLE 2 | | | | | | |
| POLE | P1 | P2 | P3 | P4 | P5 | P6 |
| POLARITY | N | S | S | S | N | S |
| PEAK FLUX DENSITY (mT) | 94 | 73 | 5 | 52 | 65 | 58 |
| CENTER HALF ANGLE (°) | 0 | 62 | 105 | 148 | 217 | 291 |
| CENTER HALF-POWER ANGLE | 45 | 46 | – | 35 | 55 | 40 |
| COMPARATIVE EXAMPLE 3 | | | | | | |
| POLE | P1 | P2 | P3 | P4 | P5 | P6 |
| POLARITY | N | S | S | S | N | S |
| PEAK FLUX DENSITY (mT) | 95 | 65 | 5 | 27 | 68 | 75 |
| CENTER HALF ANGLE (°) | 0 | 63 | 110 | 154 | 206 | 289 |
| CENTER HALF-POWER ANGLE | 50 | 37 | – | 30 | 40 | 52 |

Fig. 21

| No. | 1 | 2 | 3 | 4 | 5 | 6 |
|---|---|---|---|---|---|---|
| DRUM DIAMETER [mm] | 30 | | 60 | | 90 | |
| SLEEVE DIAMETER [mm] | 16 | | 20 | | 30 | |
| DEVELOPMENT GAP [mm] | 0.4 | | 0.4 | | 0.4 | |
| NIP [mm] | 4 | 1.5 | 4 | 2 | 7 | 4 |
| DISTANCE AT NIP BOUNDARY [mm] | 0.79 | 0.45 | 0.67 | 0.47 | 0.95 | 0.58 |
| RATIO IN DISTANCE | 1.67 | 1.17 | 2.38 | 1.45 | 1.97 | 1.13 |

DEVELOPING METHOD, DEVICE, AND IMAGE FORMING APPARATUS WITH MAGNET BRUSH

BACKGROUND OF THE INVENITON

The present invention relates to a copier, printer, facsimile apparatus or similar image forming apparatus. More particularly, the present invention relates to a developing method capable of collecting a developer left on an image carrier after image transfer with a so-called cleanerless process and a developing device for practicing the same.

A developing system using a magnet brush is extensively applied to a photographic image forming apparatus of the type using a two-ingredient type developer, i.e., a toner and carrier mixture. In the magnet brush type developing system, a developer carrier conveys a developer deposited thereon in the form of a magnet brush and causes it to contact an image carrier, which carries a latent image thereon. An electric field is formed between the image carrier and a sleeve to which an electric bias is applied. The electric field causes the toner of the developer to selectively deposit on the latent image for thereby developing the latent image.

The developer carrier has a magnet roller accommodated in the sleeve, which is usually cylindrical. The magnet roller causes the developer deposited on the sleeve to rise in the form a magnet brush. The toner, which is charged to preselected polarity, deposits on the carrier present in the magnet brush. The magnet roller has a plurality of magnetic poles each being formed by a particular rod-like or similar magnet. Among the poles, a main pole is positioned on the surface of the sleeve in a developing region for causing the developer to rise. At least one of the sleeve and magnet roller moves relative to the other so as to cause the developer forming the magnet brush on the sleeve to move.

The developer brought to the developing region rises in the form of chains along magnetic lines of force issuing from the main pole of the magnet roller. The chains contact the surface of the image carrier while yielding. The chains feed the toner to the latent image while rubbing themselves against the latent image on the basis of a difference in linear velocity between the developer carrier and the image carrier. The developing region refers to a range over which the magnet brush on the developer carrier contacts the image carrier.

The image forming apparatus has customarily included a cleaner for collecting the toner left on the image carrier after the transfer of a toner image to a paper sheet or similar recording medium. Today, a cleanerless process is available that makes the cleaner unnecessary and thereby simplifies and miniaturizes the image forming apparatus.

Development using the toner and carrier mixture is superior to development using a single ingredient type developer, i.e., toner as to durability and reliability. However, development using the toner and carrier mixture needs a development gap as great as 500 $\mu$m or above between the image carrier and the developer carrier. This gap is as small as several micrometers in development using only toner. The cleanerless process cannot surely collect the toner from the non-image area of the image carrier unless the electric field between the non-image area and the developer carrier is intensified. This kind of development therefore needs a great difference in potential and therefore high charge potential.

High charge potential, however, increases electrostatic stress to act on the image carrier to thereby reduce the life of the image carrier. Further, high charge potential aggravates the production of ozone and nitrogen oxides, resulting in an offensive smell and the blurring of an image. If the charge potential is lowered to solve the above problems, then the magnet brush strongly rubs itself against the image carrier. This causes the trailing edge of an image to be lost (omission of a trailing edge hereinafter) and obstructs the faithful reproduction of horizontal lines and dots. The resulting image is noticeably dependent on direction.

Technologies relating to the present invention are disclosed in, e.g., Japanese Patent Laid-Open Publication Nos. 7-84456, 8-160725, 9-236986, 2000-305360 and 2000-315001.

SUMMARY OF THE INVENTION

It is an object of the present invention to provide a method and an apparatus for development capable of insuring attractive images and surely collecting toner left on an image carrier with the cleanerless process.

It is another object of the present invention to provide an image forming apparatus including the above-described developing device.

BRIEF DESCRIPTION OF THE DRAWINGS

The above and other objects, features and advantages of the present invention will become more apparent from the following detailed description taken with the accompanying drawings in which:

FIG. 16 is a table comparing examples and comparative examples as to half width;

FIG. 21 is a table listing experimental results conducted with the alternative embodiment for determining the obviation of the omission of a trailing edge;

DECRIPTION OF THE PREFERRED EMBODIMENTS

Figure 1:
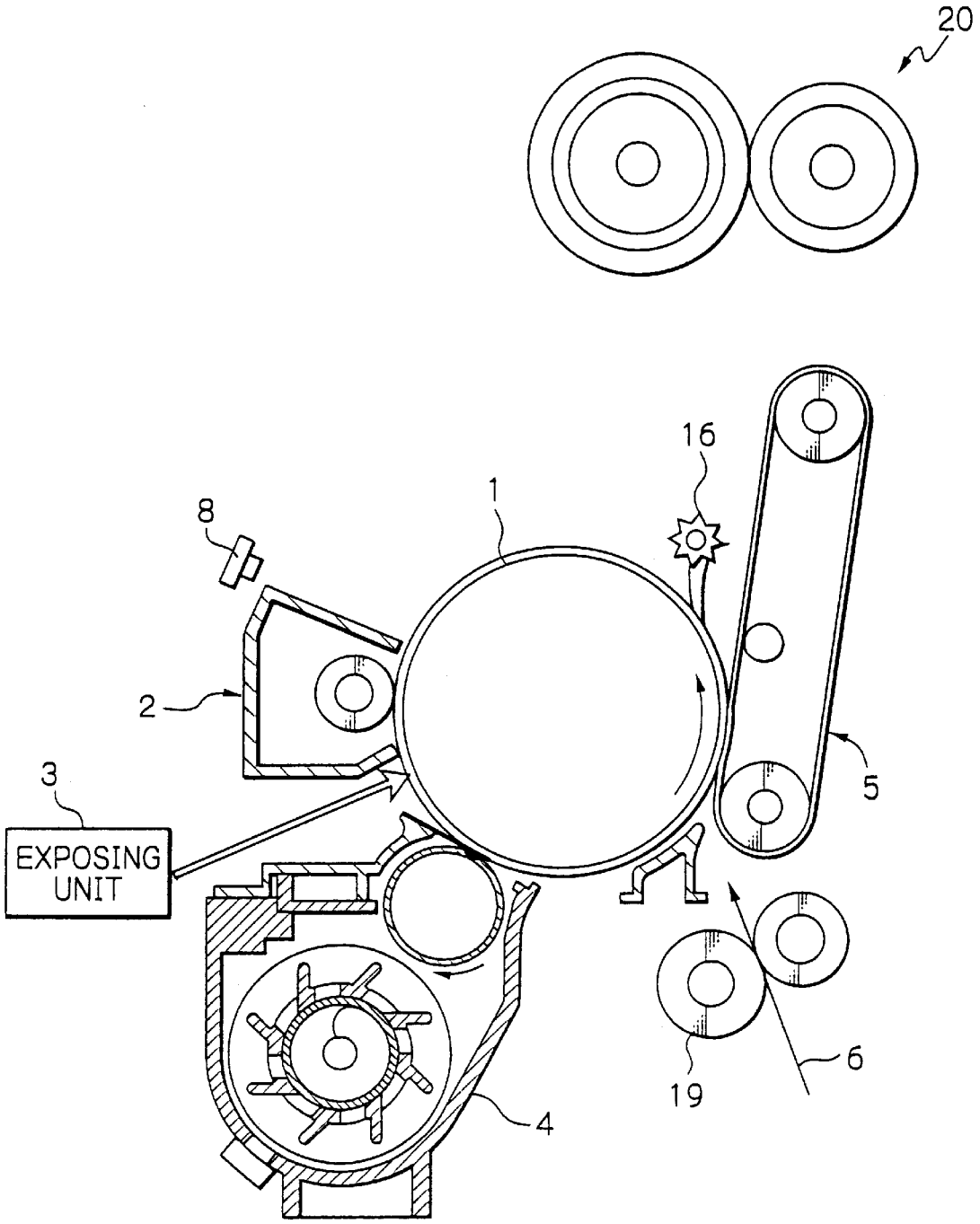
FIG. 1 is a view showing an image forming apparatus on which a developing device in accordance with the present invention is mounted.

Referring to FIG. 1 of the drawings, an image forming apparatus on which a developing device in accordance with the present invention is mounted is shown. As shown, the image forming apparatus includes a drum 1 that is a specific form of an image carrier. Arranged around the drum are a charger 2, an exposing unit 3, a developing device 4, an image transferring device 5, and a discharge lamp 8. The charger 2 uniformly charges the surface of the drum 1 to preselected polarity. The exposing unit 3 scans the charged surface of the drum 1 with a laser beam imagewise for thereby forming a latent image on the drum 1. The developing device 4 develops the latent image with toner to thereby form a corresponding toner image. The image transferring device 5 transfers the toner image from the drum 1 to a paper sheet or similar recording medium 6. The discharge lamp 8 discharges the surface of the drum 1 after the image transfer from the drum 1 to the paper sheet 6.

After the charger 2 has uniformly charged the surface of the drum 1 with a charge roller, the exposing unit 4 exposes the charged surfaced of the drum 1 imagewise for thereby forming a latent image. The developing device 4 develops the latent image with toner to thereby form a corresponding toner image. The image transferring device 5, including a belt by way of example, transfers the toner image from the drum 1 to the paper sheet 6, which is fed from a sheet tray not shown. A peeler 16 peels off the paper sheet 6 electrostatically adhering to the drum 1. A fixing unit 20 fixes the toner image on the paper sheet 6. The discharge lamp 8 initializes the surface of the drum 1 in order to prepare it for the next image formation. The toner left on the drum 1 after the image transfer is conveyed by the drum 1 via the charging position and exposing position to the developing position. At the developing position, the toner is collected from the needless portions of the drum 1 at the same time as development (next development). The reference numeral 19 designates a registration roller pair for driving the paper sheet 6 such that the leading edge of the paper sheet 6 meets the leading edge of the toner image formed on the drum 1.

Figure 2:
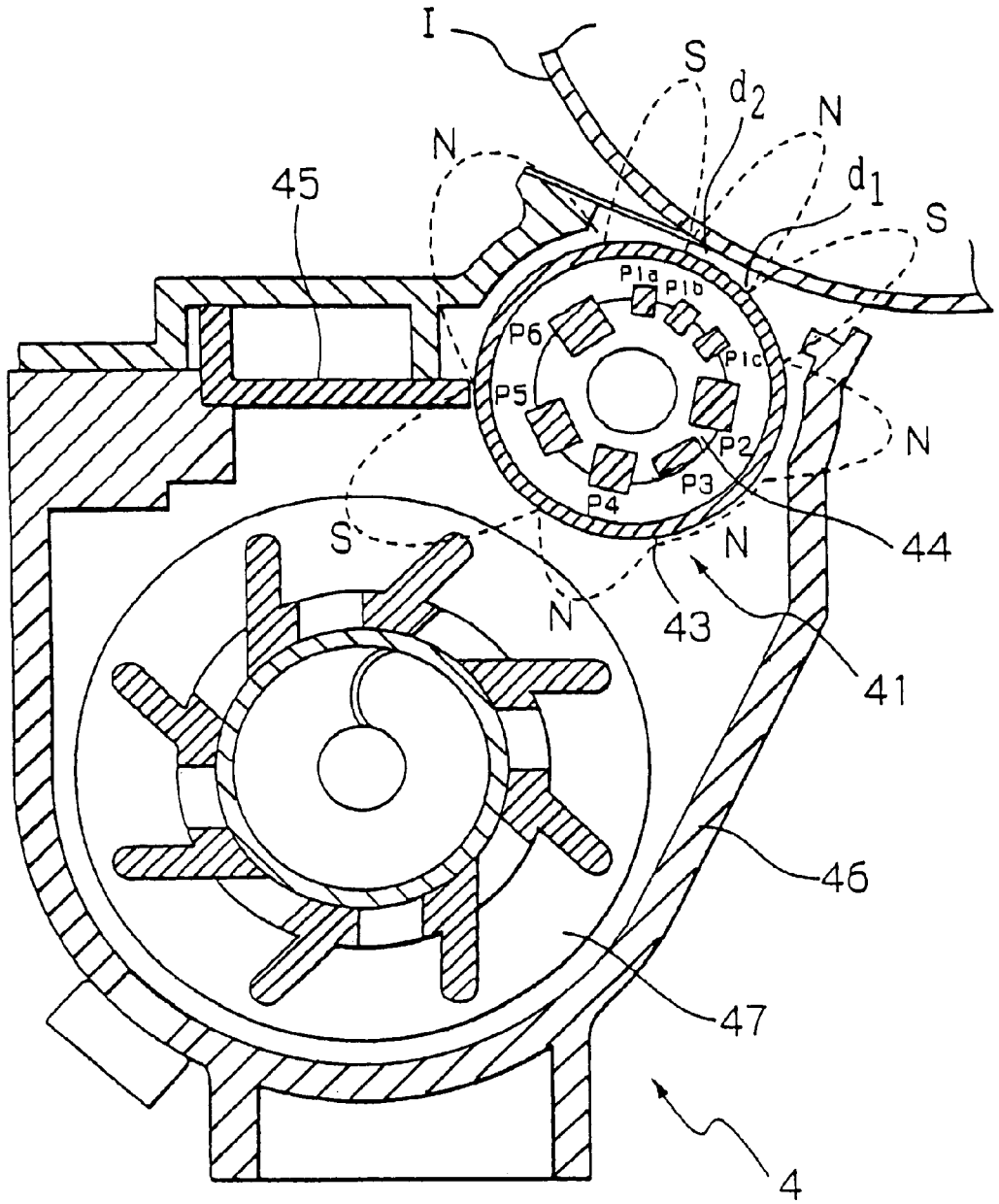
FIG. 2 is a view showing a developing device embodying the present invention in detail.

FIG. 2 shows a specific configuration of the developing device 4. As shown, the developing device 4 includes a developing roller 41 adjoining the drum 1. The developing roller 41 and drum 1 form a developing region therebetween where a magnet brush contacts the drum 1. The developing roller 41 includes a cylindrical sleeve 43 formed of aluminum, brass, stainless steel, conductive resin or similar magnetic material. A drive mechanism, not shown, causes the sleeve 43 to rotate clockwise, as viewed in FIG. 2, or in a direction of developer conveyance.

In the illustrative embodiment, the drum 1 has a diameter of 60 mm and moves at a linear velocity of 240 mm/sec. The sleeve 43 has a diameter of 20 mm and moves at a linear velocity of 600 mm/sec, which is 2.5 times as high as the linear velocity of the drum 1. A development gap between the drum 1 and the sleeve 43 is 0.4 mm. For a mean carrier particle size of 50 $\mu$m, the development gap has customarily been about 0.65 nm to about 0.8 mm, which is ten times or more as great as the developer particle size. A required image density is achievable even if the ratio in linear velocity of the sleeve 43 to the drum 1 is reduced to 1.1.

A latent image whose potential is −800 V in a non-image portion and −150 V in an image portion is formed on the drum 1. In this condition, by applying a bias of −600 V to the sleeve 43, it is possible to collect toner from the drum 1 while executing development. If the mean carrier particle size is 50 m or less and if the development gap is 0.4 mm or less, then there can be obviated the omission of a trailing edge, a residual image ascribable to defective toner collection, and brush marks ascribable to a magnet brush.

Even when the potentials in the non-image portion and image portion are respectively −500 V and −100 V, the toner can be collected from the drum 1 if a bias of −400 V is applied to the sleeve 43. In this case, if the mean carrier particle size is 50 $\mu$m or less and if the development gap is 0.35 mm or less, then there can be obviated the omission of a trailing edge, a residual image ascribable to defective toner collection, and brush marks ascribable to a magnet brush.

A doctor blade or metering member 45 is positioned upstream of a developing region in the direction of developer conveyance for regulating the height of a magnet brush formed on the sleeve 43. A doctor gap between the doctor blade 45 and the sleeve 43 is selected to be 0.4 mm. A screw 47 is positioned at the opposite side to the drum 1 with respect to the developing roller 41. The screw 47 scoops up the developer stored in a casing 46 to the developing roller 41 while agitating it.

A magnet roller 44 is held stationary within the sleeve 43 for causing the developer to form a magnet brush on the sleeve 43. Specifically, the magnet roller 44 causes the carrier of the developer to rise on the sleeve 43 in the form of chains along magnetic lines of force normal to the sleeve 43. The toner of the developer deposits on the carrier or chains, forming the magnet brush. The sleeve 43 conveys the magnet brush formed thereon in the clockwise direction.

The magnet roller 44 has a plurality of magnetic poles or magnets P1*a* through P1*b* and P2 through P6. The pole or main pole P1*b* causes the developer to rise in the developing region where the sleeve 43 and drum 1 face each other. The poles P1*a* and P1*c* help the main pole P1*b* exert such a magnetic force. The pole P4 scoops up the developer to the sleeve 43. The poles P5 and P6 convey the developer to the developing region. The poles P2 and P3 convey the developer in a region following the developing region. All of the poles of the magnet roller 44 are oriented in the radial direction of the sleeve 43. While the magnet roller 44 is shown as having eight poles, additional poles may be arranged between the pole P3 and the doctor blade 45 in order to enhance the scoop-up of the developer and the ability to follow a black solid image. For example, two to four additional poles may be arranged between the pole P3 and the doctor blade 45.

As shown in FIG. 2, the poles P1*a* through P1*c* are sequentially arranged from the upstream side to the downstream side in the direction of developer conveyance, and each is implemented by a magnet having a small sectional area. While such magnets are formed of a rate earth metal alloy, they may alternatively be formed of, e.g., a samarium alloy, particularly a samarium-cobalt alloy. An iron-neodium-boron alloy, which is a typical rare earth metal alloy, has the maximum energy product of 358 kJ/m$^3$. An ion-neodium-boron alloy bond, which is another typical rare earth metal, has the maximum energy product of 80 kJ/m$^3$ or so. Such magnets guarantee magnetic forces required of the surface of the developing roller 41 despite their small sectional area. A ferrite magnet and a ferrite bond magnet, which are conventional, respectively have the maximum energy products of about 36 kJ/m$^3$ and 20 kJ/m$^3$. If the sleeve 43 is allowed to have a greater diameter, then use may be made of ferrite magnets or ferrite bond magnets each having a relatively great size or each having a tip tapered toward the sleeve 43 in order to reduce a half width.

As shown in FIG. 2, $d_1$ and $d_2$ represent, respectively, a distance between the image carrier and the developer carrier at the nip, and the distance between the image carrier and the developer carrier at a closest point.

Figure 3:
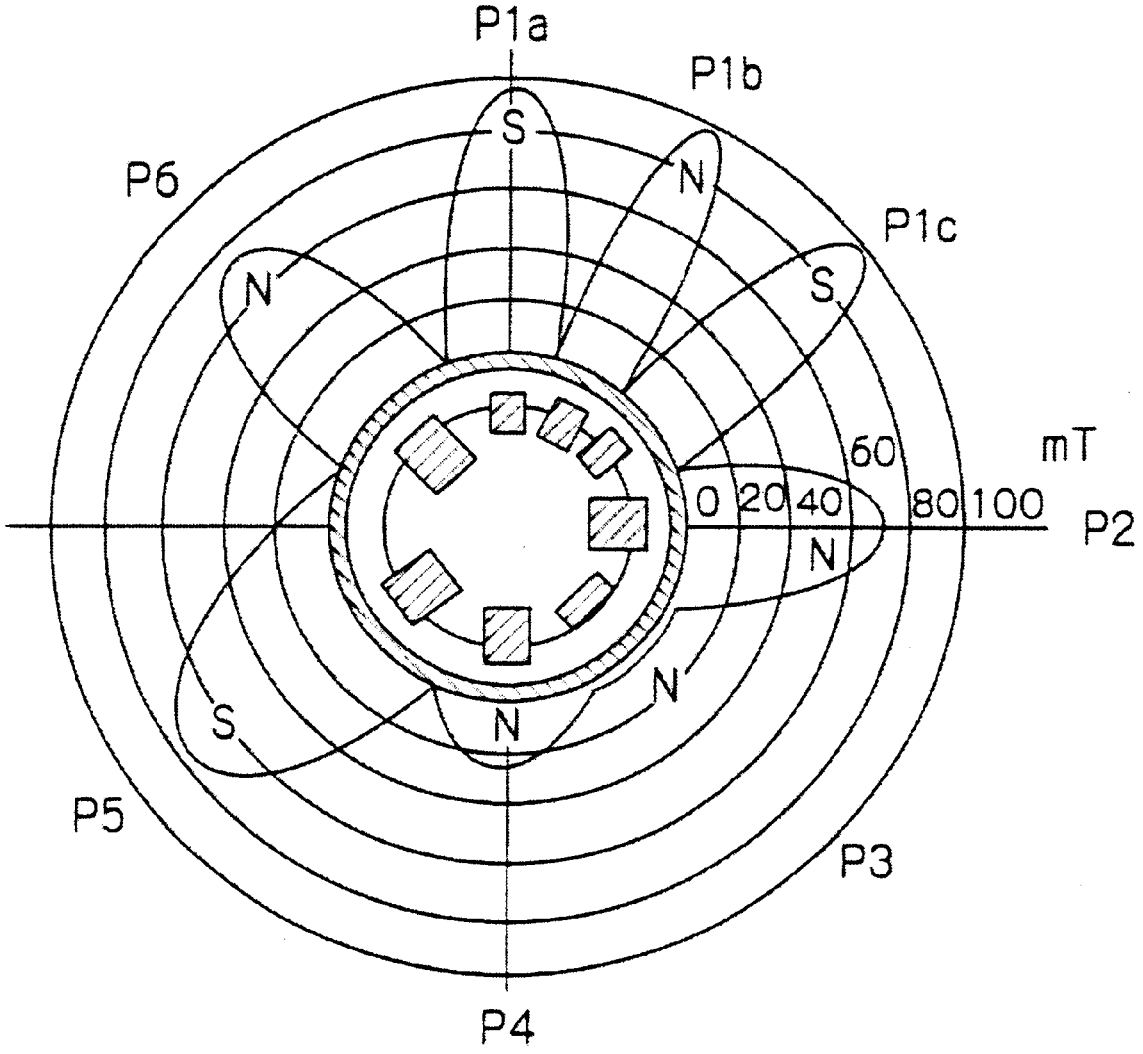
FIG. 3 is a chart showing the magnetic force distribution and its size available with a developing roller included in the illustrative embodiment.

In the above specific configuration, the main pole P1*b* and poles P4, P6, P2 and P3 are N poles while the poles P1*a*, P1*c* and P5 are S poles. As shown in FIG. 3, the main magnet P1*b* had a magnetic force of 85 mT or above, as measured on the developing roller 41. It was experimentally found that if the main pole P1*b* and auxiliary pole downstream of the main pole P1*b* had a magnetic force of 60 mT or above, defects including the deposition of the carrier were obviated. The magnet P2 downstream of the main magnet P1 presumably helps the main magnet P1 exert the main magnetic force. The deposition of the carrier occurred when the above magnetic force was less than 60 mT. Magnetic forces contributing to the deposition of the carrier are tangential to the developing roller 41. While the magnetic forces of the magnets P1*a* through P1*c* must be intensified to intensify the tangential magnetic forces, the deposition of the carrier can be reduced only if any one of such magnetic forces is intensified. The magnets P1*a* through P1*c* each had a width of 2 mm while the magnet P1*b* had a half width of 16°.

Figure 4:
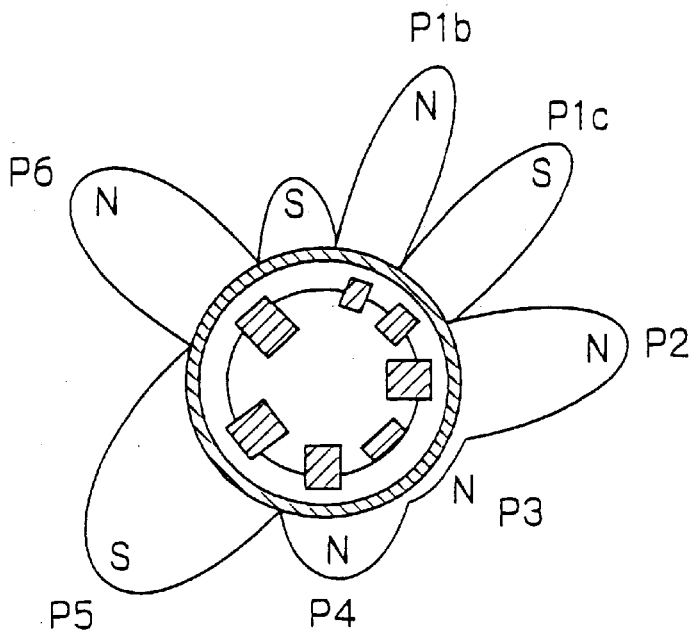
FIG. 4 is a chart showing the magnetic force distribution and its size available when an auxiliary magnetic pole P1*a* is absent.

As shown in FIG. 4, only the auxiliary magnet P1*c* may be positioned downstream of the main magnet P1*b*. In this configuration, the half width of the main magnet P1*b* is the same as in the configuration or FIG. 3; the magnetic force of the main pole P1*b* decreases only by several percent. While the auxiliary magnet P1*a* is absent at the upstream side of the main magnet P1*b*, the magnetic force at the upstream side decreases to about 30 mT, as determined by experiments. However, this position is usually shielded by an inlet seal and not exposed to the image forming section, so that the developer can be fed to the main pole.

Figure 5:
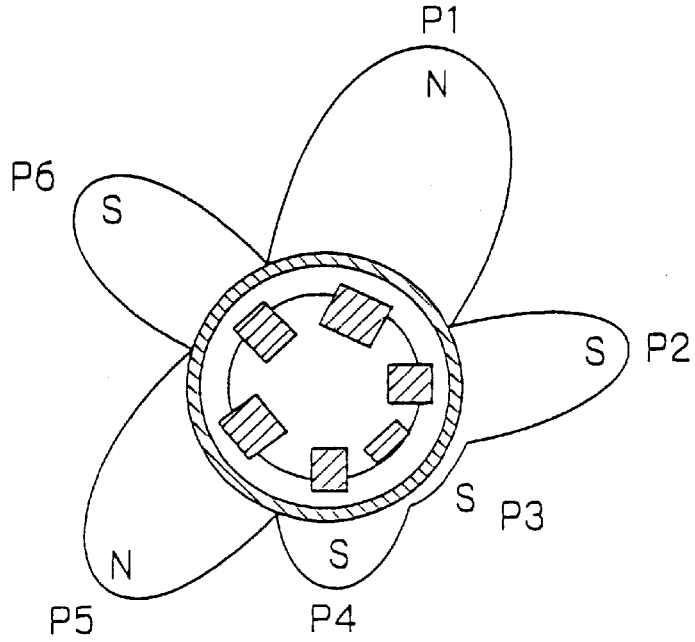
Fig. 5 PRIOR ART
FIG. 5 is a chart showing a magnetic force distribution of a conventional developing roller for comparison.

By reducing the width of the magnet, It is possible to further reduce the half width, as determined by experiments. When the main pole was implemented by a 1.6 mm wide magnet, the half width was as small as 12°. As FIG. 3 indicates, the maximum magnetic force of the main magnet P1*b* in the normal direction is 90 mT. In this case, the half width is 45 mT while its angular width is 25°. Half widths above 25° resulted in defective images. For comparison, FIG. 5 shows a magnetic force distribution particular to the conventional magnet roller.

Figure 6:
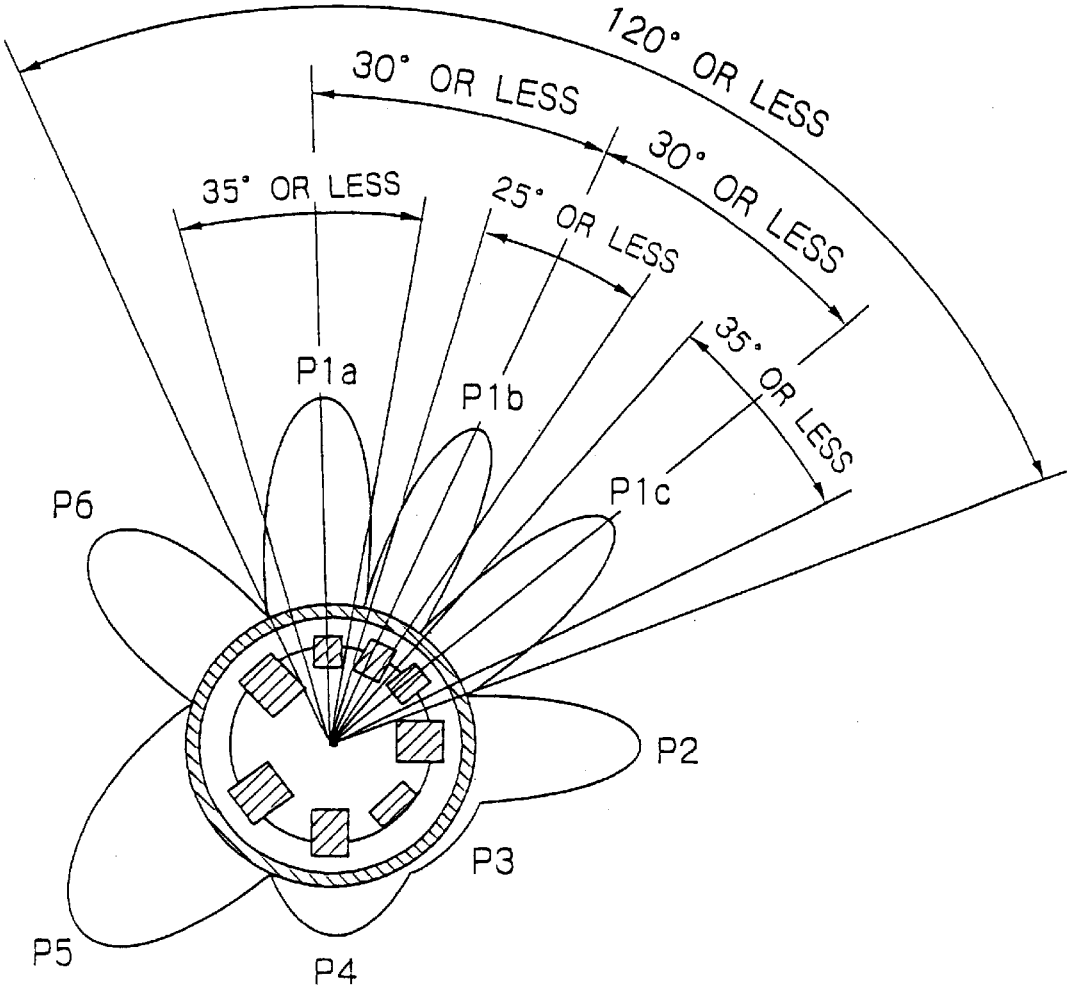
FIG. 6 is a chart showing a relation between a main magnet and magnets adjoining it.

In the illustrative embodiment, the half width of each of the auxiliary magnets P1*a* and P1*c* is selected to be 35° or below. This half width cannot be reduced relatively because the magnets P2 and P6 positioned outside of the magnets P1*a* and P1*c* have great half widths. FIG. 6 shows a positional relation between the main magnet P1*b* and the auxiliary magnets P1*a* and P1*c*. As shown, the angle between the each of the auxiliary magnets P1*a* and P1*c* and the main magnet P1*b* is selected to be 30° or below. More specifically, because the half width of the main pole P1*a* is 16°, the above angle is selected to be 25°. Further, the angle between the transition point (0 mT) between the magnets P1*a* and P6 and the transition point (0 mT) between the magnets P1*c* and P2 is selected to be 120° or below. The transition point refers to a point where the N pole and S pole replace each other.

Figure 7:
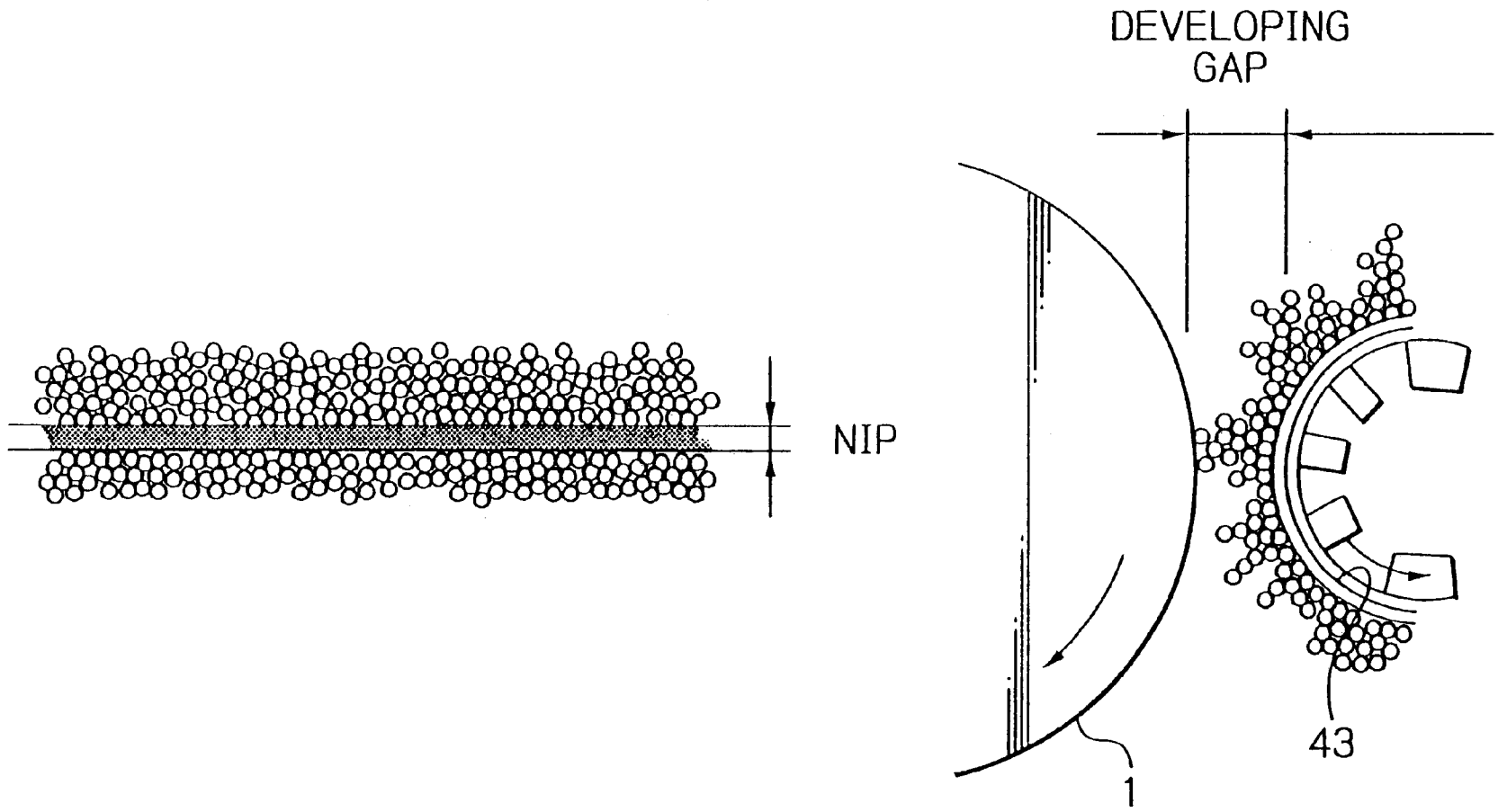
FIG. 7 is a view showing the size of the development gap and that of a nip.
Figure 8:
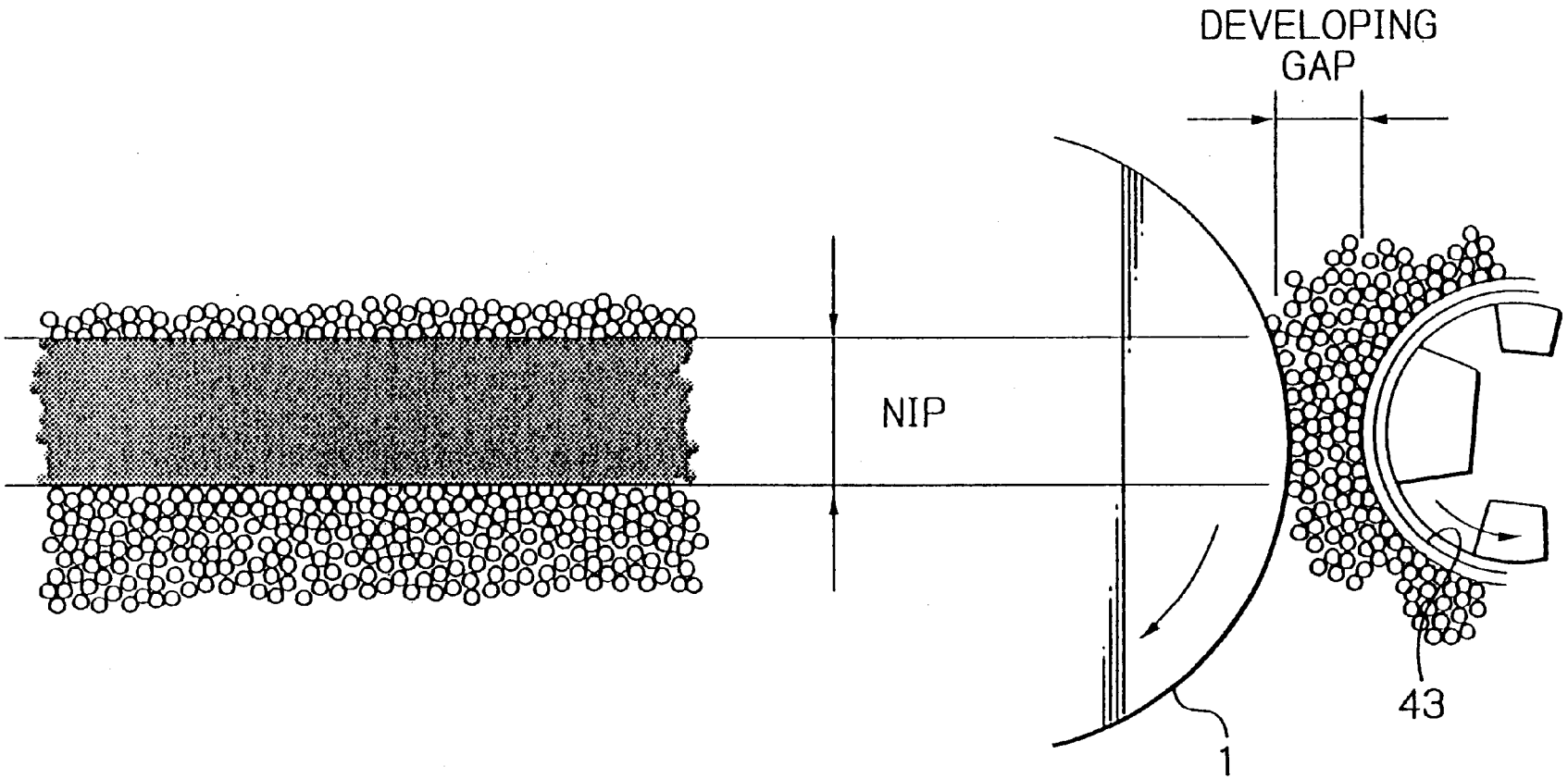
Fig. 8 PRIOR ART
FIG. 8 is a view showing the size of the development gap and that of the nip of a conventional arrangement for comparison.

So long as the magnet brush contacts the drum 1 under the above conditions, the nip is greater than or equal to the particle size of the developer, but smaller than or equal to 2 mm, obviating the omission of a trailing edge. In addition, even a horizontal thin line and a single dot or similar small image can be sufficiently formed. FIGS. 7 and 8 respectively show a condition particular to this specific configuration and a conventional condition for comparison.

As stated above, in the illustrative embodiment, the half width of the magnetic flux of the main pole and therefore the development gap is reduced. With this configuration, the illustrative embodiment forms a sufficiently strong electric field even at the boundary of the developing region. The magnet brush can therefore efficiently collect the toner left on the drum 1 after image transfer.

Figure 9:
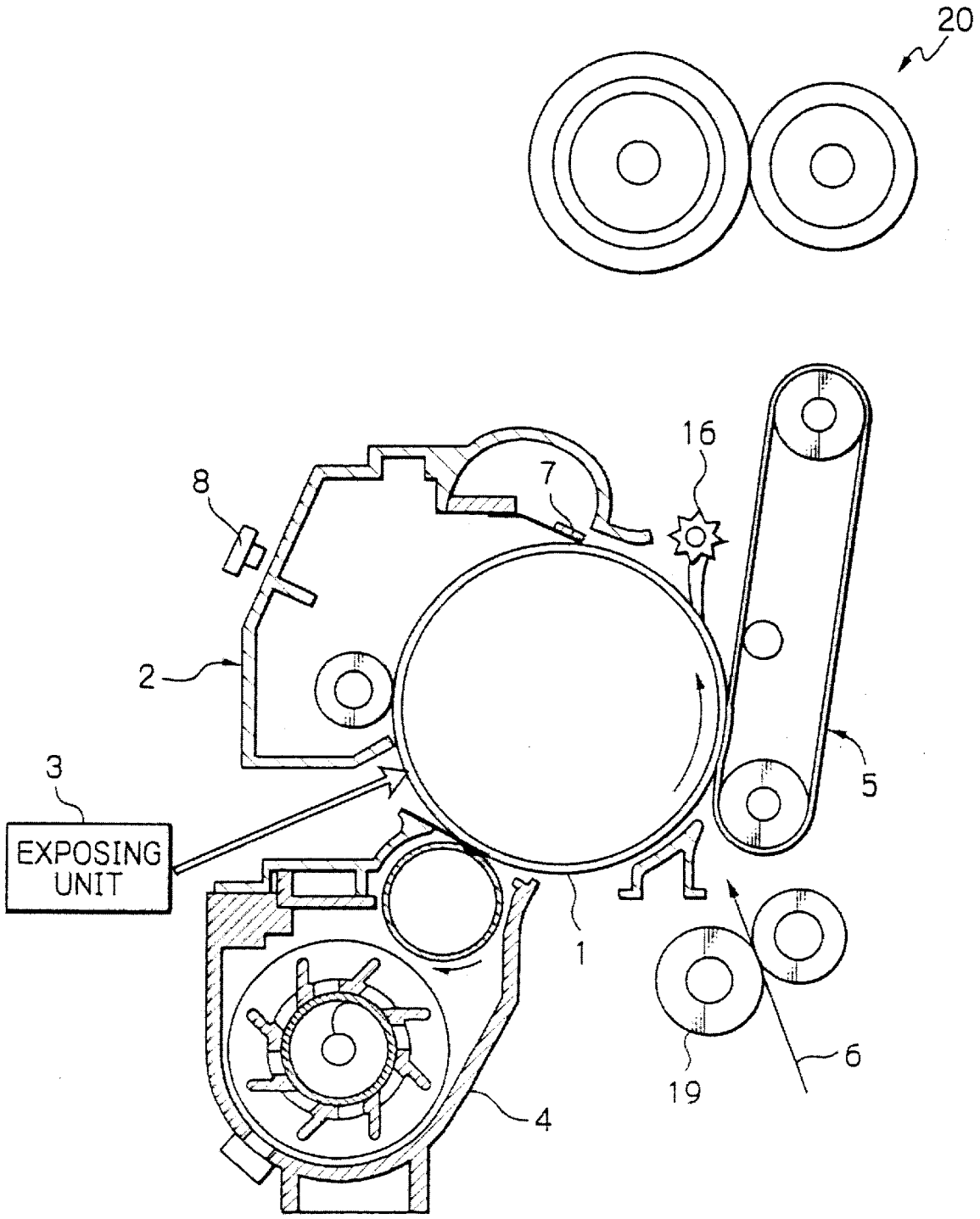
FIG. 9 is view showing a modification of the illustrative embodiment including a leveling member.

As shown in FIG. 9, the image forming apparatus may include a leveling member 7. The leveling member lightly rubs itself against the toner left on the drum 1 after image transfer, preventing the toner from locally gathering on the surface of the drum 1. This protects exposure from irregular screening and thereby insures adequate formation of a latent image. Further, at the developing position, the magnet brush can collect the toner with higher efficiency so as to reduce the possibility of a residual Image. The leveling member 7 should preferably be formed of a material that does not scratch the surface of the drum 1. For example, the leveling member 7 may be implemented as a flexible sheet.

Figure 10:
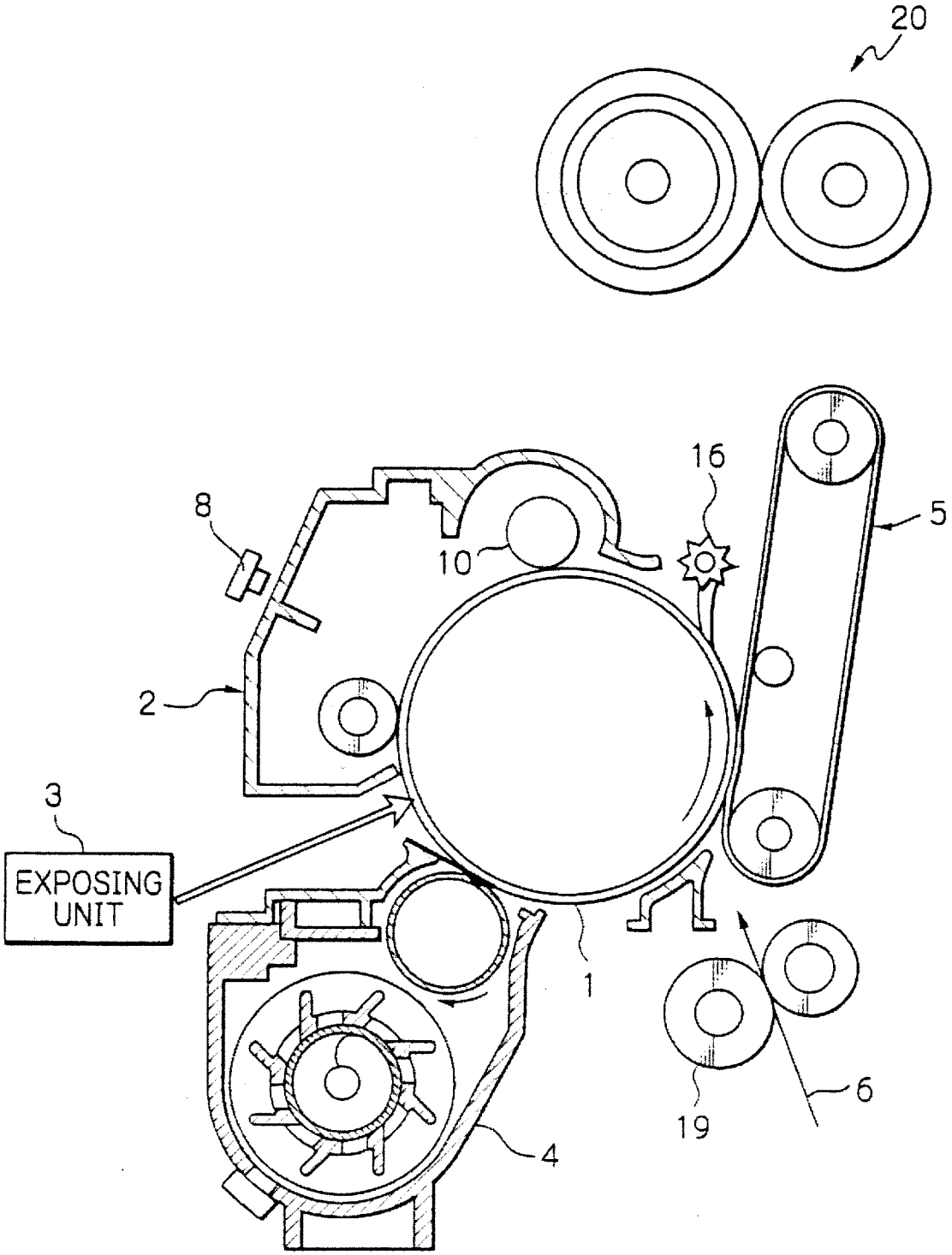
FIG. 10 is a view showing another modification of the illustrative embodiment including a temporary collection roller.

As shown in FIG. 10, the image forming apparatus may alternatively include a temporary collection roller 10 located downstream of the image transfer position. The temporary collection roller 10 extends in the axial direction of the drum 1 and is applied with a bias for collection. The roller 10 collects the toner left on the drum 1 after image transfer and then returns it to the drum 1 when the non-image area of the drum 1 arrives. That is the roller 10 causes the toner to again deposit on the drum 1 while being scattered, or distributed, on the surface of the drum 1. This also protects exposure from irregular screening and thereby insures adequate formation of a latent image. Further, at the developing position, the magnet brush can collect the toner with higher efficiency so as to reduce the possibility of a residual image.

The temporary collection roller 10 is selectively driven by the drum 1 in contact therewith or by a drive source, as will be described specifically later. The roller 10 is elastic enough to protect the drum 1 from damage and should preferably be formed of sponge that easily retains the toner. Further, the material of the drum 10 should preferably belong to a charge series that allows the drum 10 to charge the toner to expected polarity in contact therewith.

Figure 12:
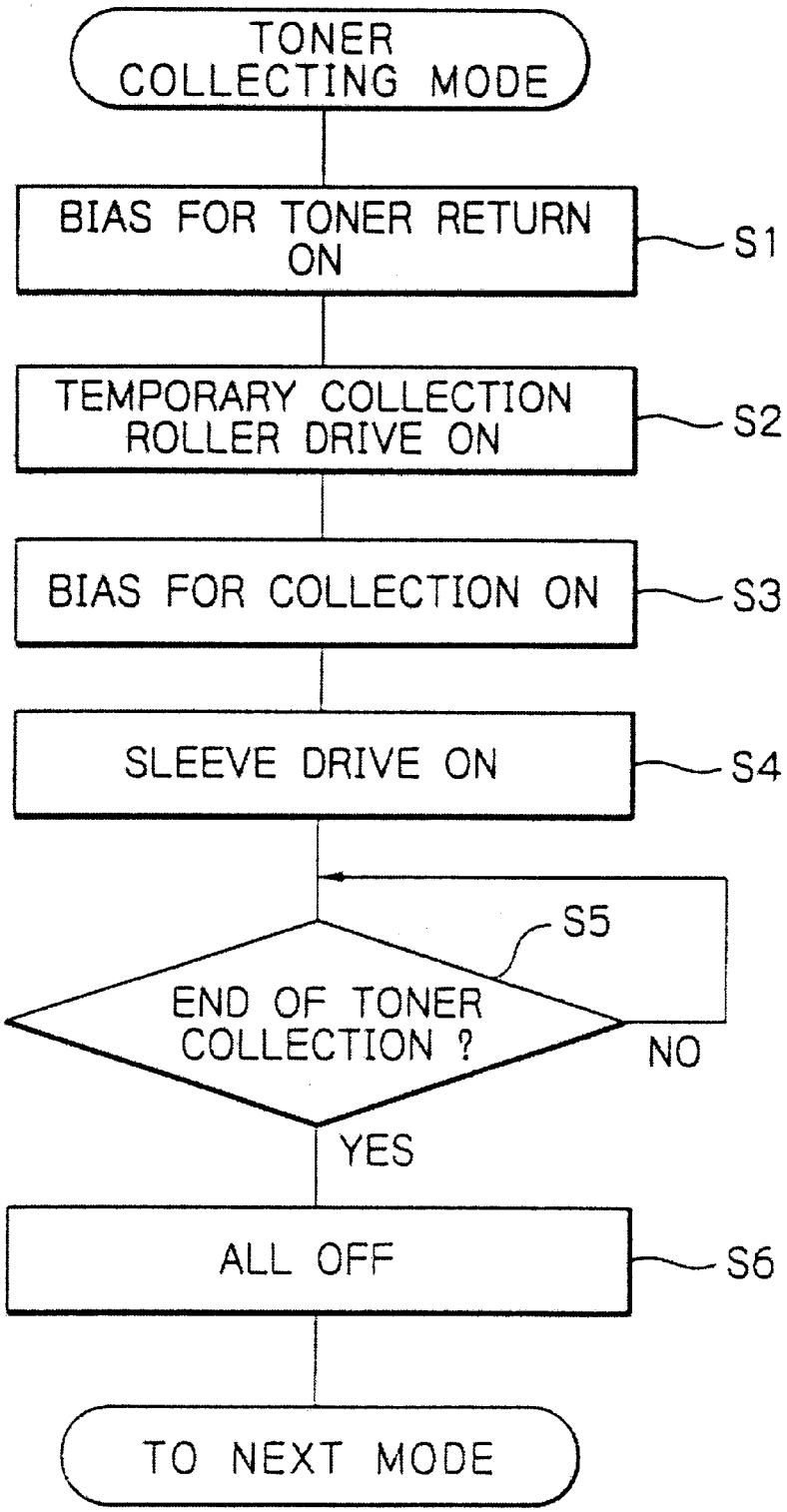
FIG. 12 is a flowchart demonstrating a toner collecting mode also unique to the illustrative embodiment.

FIG. 12 demonstrates an image forming mode practicable with the configuration shown in FIG. 10 for forming a toner image in the usual manner. As shown, a bias is applied to the charger 2 (step S1), and exposure begins (step S2). Subsequently, a bias for development is applied to the developing device 4 (step S3) with the sleeve 43 being rotated (step S4). A bias for image transfer is applied to the image transferring device 5 (step S5). Further, a bias for toner collection is applied to the temporary collection roller 10 (step S6); if the toner is charged to negative polarity, then the bias is a positive bias. In this mode operation, the temporary collection roller 10 is caused to rotate by the drum 1. When the image formation ends in a preselected period of time (step S7), all the operations in the steps S1 through S6 end (step S8). This is followed by a toner collecting mode that will be described hereinafter with reference to FIG. 12. In the toner collecting mode, the temporary collection roller 10 returns the collected toner to the drum 1 and allows it to be collected by the developing device 4.

As shown in FIG. 12, a bias for toner return 1s applied to the temporary collection roller 10 (step S1); if the toner is charged to negative polarity, then the bias is a negative bias. At the same time, the previously mentioned drive source causes the roller 10 to rotate (step S2). A bias for toner collection, which causes the toner to move toward the sleeve 43 away from the drum 1, is applied to the developing device 4 (step S3). At the same time, the sleeve 4 is caused to rotate (step S4) At this instant, a bias may be applied to the charger 2 in order to uniform the polarity and amount of charge deposited on the toner, if desired. When the toner collection by the developing device ends in a preselected period of time (step S5), all the operations in the steps S1 through S4 end (step S6).

The image forming mode and toner collecting mode may be executed in any suitable manner. For example, the two different modes may be executed alternately. Alternatively, the toner collecting mode may be executed every time the image forming mode is repeated ten consecutive times.

Figure 13:
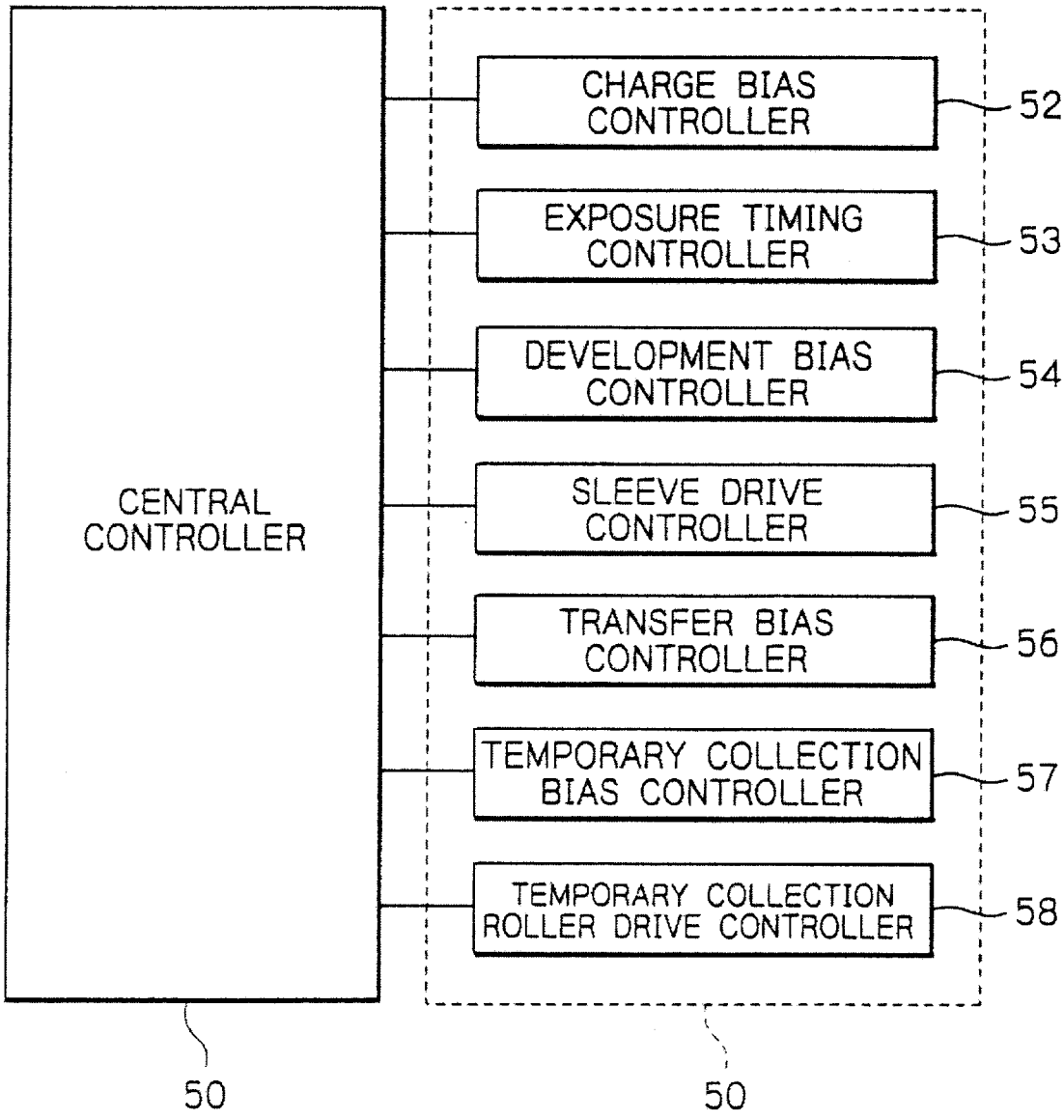
FIG. 13 is a block diagram schematically showing a control system included in the illustrative embodiment.

FIG. 13 shows a control system relating to the configuration of FIG. 10. As shown, the control system includes a central controller 50 and a local control section 51. The central controller 50 includes a CPU (Central Processing Unit), a ROM (Read Only Memory), a RAM (Random Access Memory) and so forth although not shown specifically. The central controller 50 stores a control program for executing the image forming mode and toner collecting mode described above. The local control section 51 includes a charge bias controller 52, an exposure timing controller 53, a development bias controller 54, a sleeve drive controller 55, an image transfer bias controller 56, a temporary collection bias controller 57, and a temporary collection roller drive controller 58.

While the illustrative embodiment has concentrated on three magnets forming the main pole for development, the number of magnets for forming the main pole is open to choice so long as the sufficiently strong electric field can be formed at the boundary of the developing region.

Figure 14:
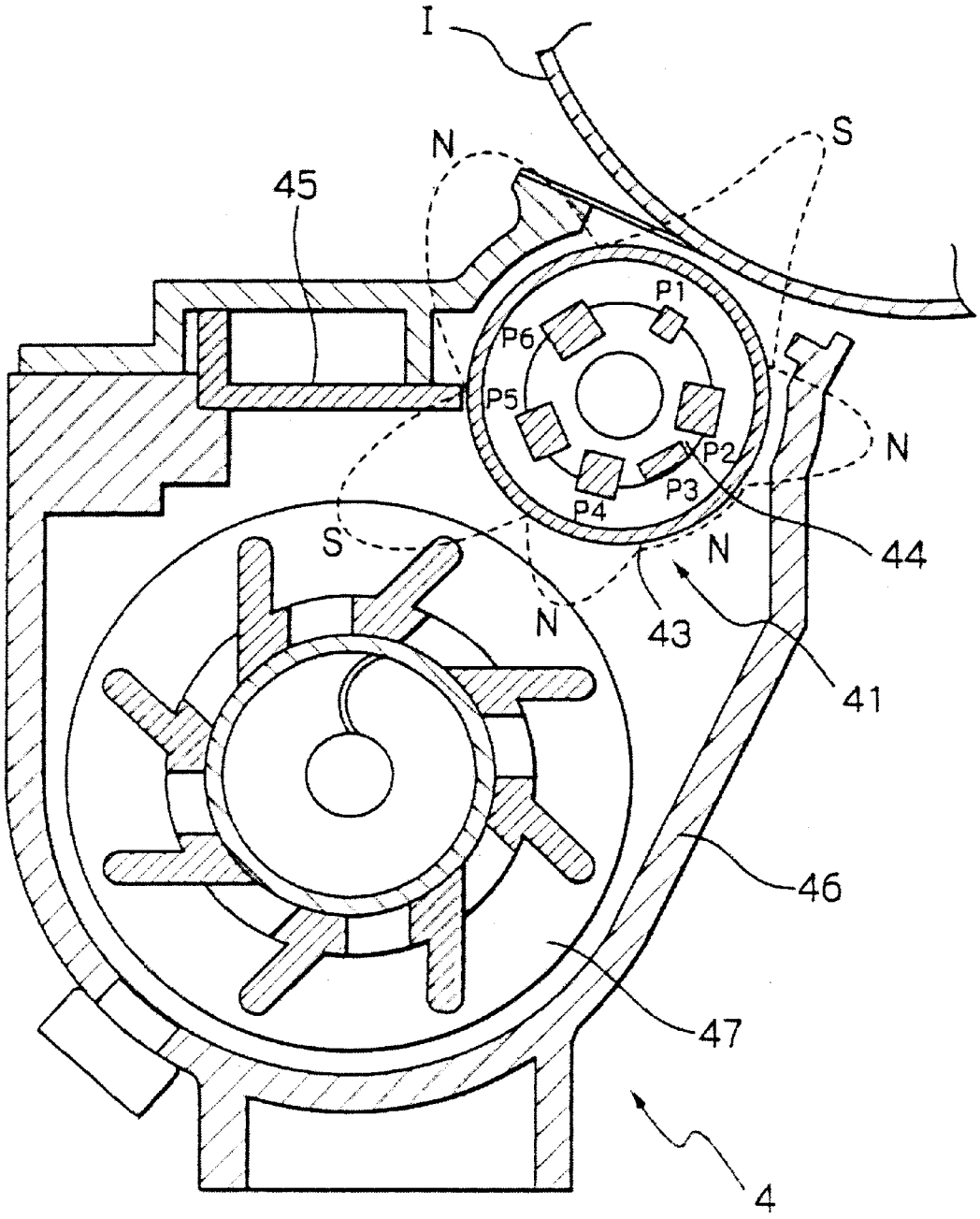
FIG. 14 is a view showing an alternative embodiment of the present invention.

Reference will be made to FIG. 14 for describing an alternative embodiment of the present invention in which a single magnet forms the main pole for development. Symbols identical with the symbols of the previous embodiment designate identical structural elements. As shown, the developing device 4 includes the developing roller 41 adjoining the drum 1. The developing roller 41 and drum 1 form a developing region therebetween where a magnet brush contacts the drum 1. The developing roller 41 includes a cylindrical sleeve 43 formed of aluminum, brass, stainless steel, conductive resin or similar magnetic material. A drive mechanism, not shown, causes the sleeve 43 to rotate clockwise, as viewed in FIG. 14.

In the illustrative embodiment, the drum 1 has a diameter of 60 mm and moves at a linear velocity of 240 mm/sec. The sleeve 43 has a diameter of 20 mm and moves at a linear velocity of 600 mm/sec, which is 2.5 times as high as the linear velocity of the drum 1. The development gap between the drum 1 and the sleeve 43 is 0.4 mm. For a mean carrier particle size of 50 $\mu$m, the development gap has customarily been about 0.65 mm to about 0.8 mm, which is ten times or more as great as the developer particle size. A required image density is achievable even if the ratio in linear velocity of the sleeve 43 to the drum 1 is reduced to 1.1.

A latent image whose potential is −800 V in a non-image portion and −150 V in an image portion is formed on the drum 1. In this condition, by applying a bias of −600 V to the sleeve 43, it is possible to collect toner from the dru1m 1 while executing development. If the mean carrier particle size is 50 $\mu$m or less and if the development gap is 0.4 mm or less, then there can be obviated the omission of a trailing edge, a residual image ascribable to defective toner collection, and brush marks ascribable to a magnet brush.

Even when the potentials in the non-image portion and image portion are respectively −500 V and −100 V, the toner can be collected from the drum 1 if a bias of −400 V is applied to the sleeve 43. In this case, if the mean carrier particle size is 50 $\mu$m or less and if the development gap is 0.35 mm or less, then there can be obviated the omission of a trailing edge of an image, a residual image ascribable to defective toner collection, and brush marks ascribable to a magnet brush.

The doctor blade or metering member 45 is positioned upstream of a developing region in the direction of developer conveyance for regulating the height of a magnet brush formed on the sleeve 43. A doctor gap between the doctor blade 45 and the sleeve 43 is selected to be 0.4 mm. The screw 47 is positioned at the opposite side to the drum 1 with respect to the developing roller 41. The screw 47 scoops up the developer stored in a casing 46 to the developing roller 41 while agitating it.

The magnet roller 44 is held stationary within the sleeve 43 for causing the developer to form a magnet brush on the sleeve 43. Specifically, the magnet roller 44 causes the carrier of the developer to rise on the sleeve 43 in the form of chains along magnetic lines of force normal to the sleeve 43. The toner of the developer deposits on the carrier or chains, forming the magnet brush. The sleeve 43 conveys the magnet brush formed thereon in the clockwise direction.

The magnet roller 44 has a plurality of magnetic poles or magnets P1 through P6. The pole or main pole P1 causes the developer to rise in the developing region where the sleeve 43 and drum 1 face each other. The pole P4 scoops up the developer to the sleeve 43. The poles P5 and P6 convey the developer to the developing region. The poles P2 and P3 convey the developer in a region following the developing region. All of the poles of the magnet roller 44 are oriented in the radial direction of the sleeve 43. While the magnet roller 44 is shown as having six poles, additional poles may be arranged between the pole P3 and the doctor blade 45 in order to enhance the scoop-up of the developer and the ability to follow a black solid image. For example, two or more additional poles may be arranged between the pole P3 and the doctor blade 45.

As shown in FIG. 14, the main pole P1 is implemented by a magnet having a small cross-sectional area. While such a magnet is formed of a rate earth metal alloy, it may alternatively be formed of, e.g., a samarium alloy, particularly a samarium-cobalt alloy. An iron-neodium-boron alloy, which is a typical rare earth metal alloy, has the maximum energy product of 358 kJ/m$^3$. An ion-neodium-boron alloy bond, which is another typical rare earth metal, has the maximum energy product of 80 kJ/m$^3$ or so. Such a magnet guarantees a magnetic force required of the surface of the developing roller 41 despite its small sectional area. A ferrite magnet and a ferrite bond magnet, which are conventional, respectively have the maximum energy products of about 36 kJ/m$^3$ and 20 kJ/m$^3$. If the sleeve 43 is allowed to have a greater diameter, then use may be made of a ferrite magnet or a ferrite bond magnet having a relatively great size or having a tip tapered toward the sleeve 43 in order to reduce a half width.

Figure 15:
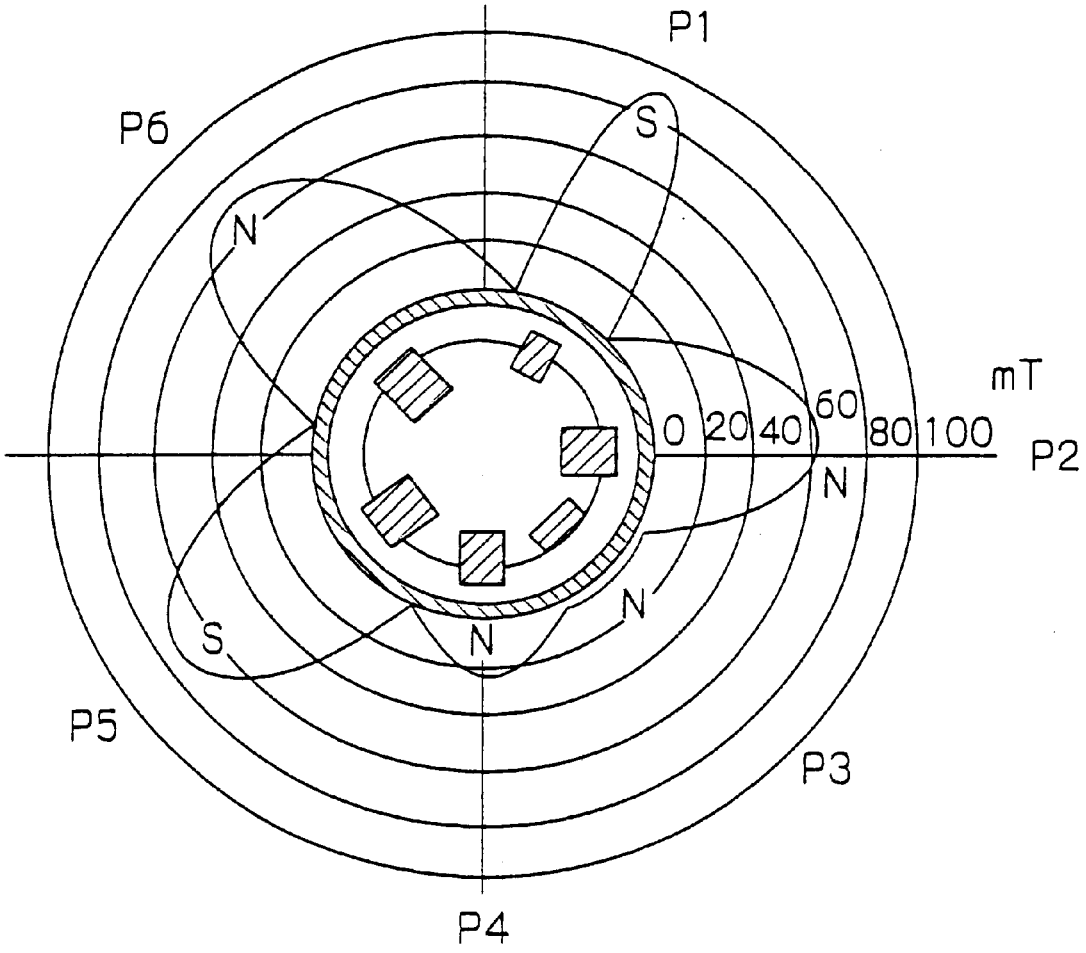
FIG. 15 is a chart showing the magnetic force distribution and the size thereof available with the alternative embodiment.

In the illustrative embodiment, the poles P4, P6, P2 and P3 are N poles while the poles P1 and P5 are S poles. As shown in FIG. 15, the main magnet P1 had a magnetic force of 85 mT or above, as measured on the developing roller 41. It was experimentally found that if the main pole P1 had a magnetic force of 60 mT or above, defects including the deposition of the carrier were obviated. The magnet P2 downstream of the main magnet P1 presumably helps the main magnet P1 exert the main magnetic force. The deposition of the carrier occurred when the above magnetic force was less than 60 mT. The magnet P1 had a width of 2 mm while the magnet P1 had a half width of 22°.

By reducing the width of the magnet, it is possible to further reduce the half width, as determined by experiments. When the main pole was implemented by a 1.6 mm wide magnet, the half width was as small as 16°. Half widths above 25° resulted in defective images. For comparison, FIG. 15 shows a magnetic force distribution particular to the conventional magnet roller.

FIG. 16 shows examples 1 through 5 and comparative examples 1 through 3 each showing a relation between the half widths of the poles P1 through P6. The half width of the pole P1 was used as a reference. In FIG. 16, symbol "-" indicates that a half width could not be determined. The polarities shown in FIG. 16 are only illustrative. For example, the pole P1 may be a S pole. Also, the poles P1 through P5 may be a N pole, a N pole, a N pole, a S pole and a N pole, respectively. In all of Examples 1 through 5, the pole P1 exerts a weaker magnetic force than the other poles P2 through P5 in order to obviate defective images. Comparative Examples 1 through 3 brought about defects including the omission of a trailing edge and a poor horizontal/vertical ratio.

Figure 17:
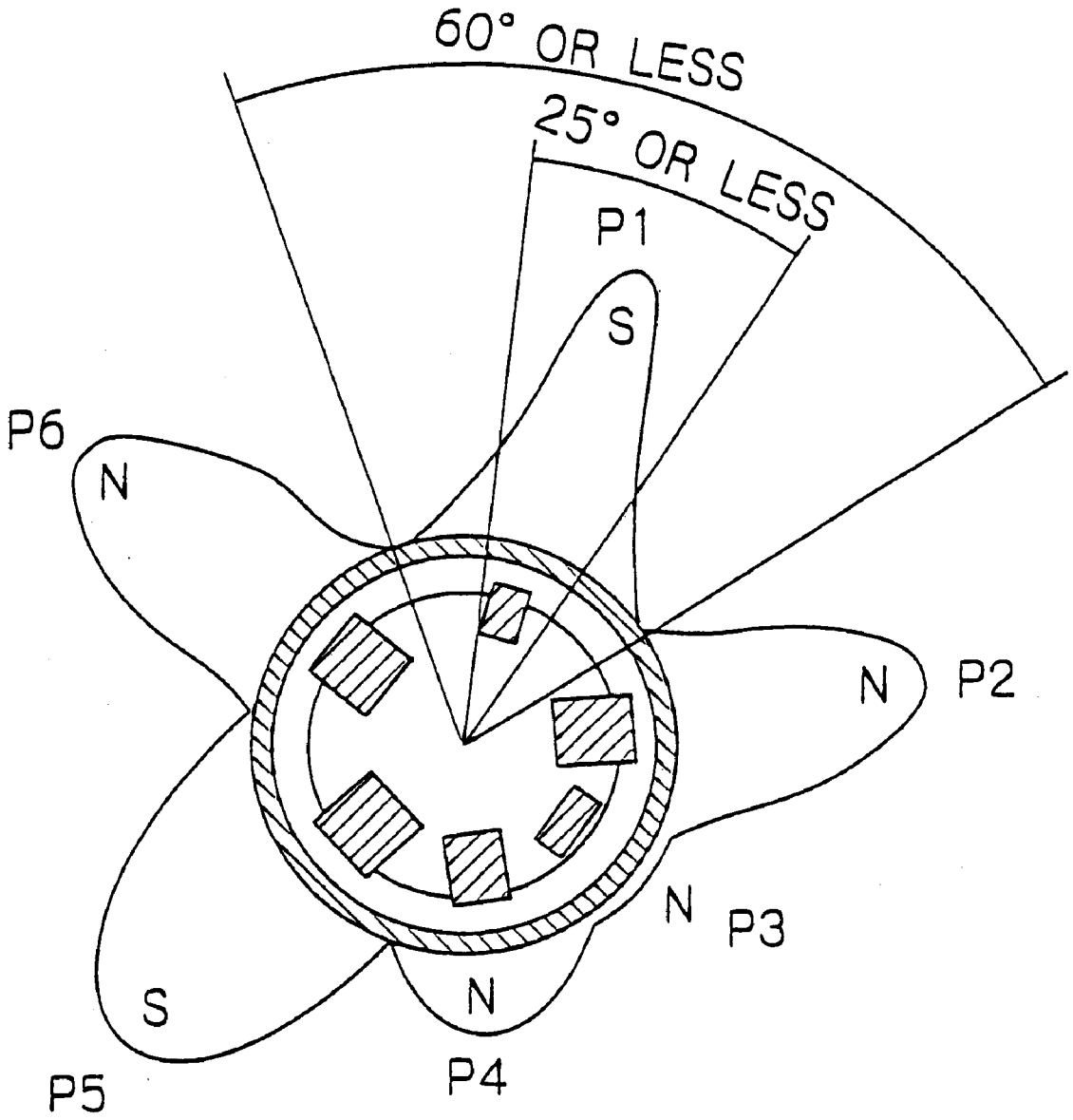
FIG. 17 is a chart showing a relation between a main magnet and magnets adjoining it.

Further, as shown in FIG. 17, the angle between the transition point between the main pole P1 and the pole P2 and the transition point between the main pole P1 and the pole 6 is selected to be 60° or below.

Figure 18:
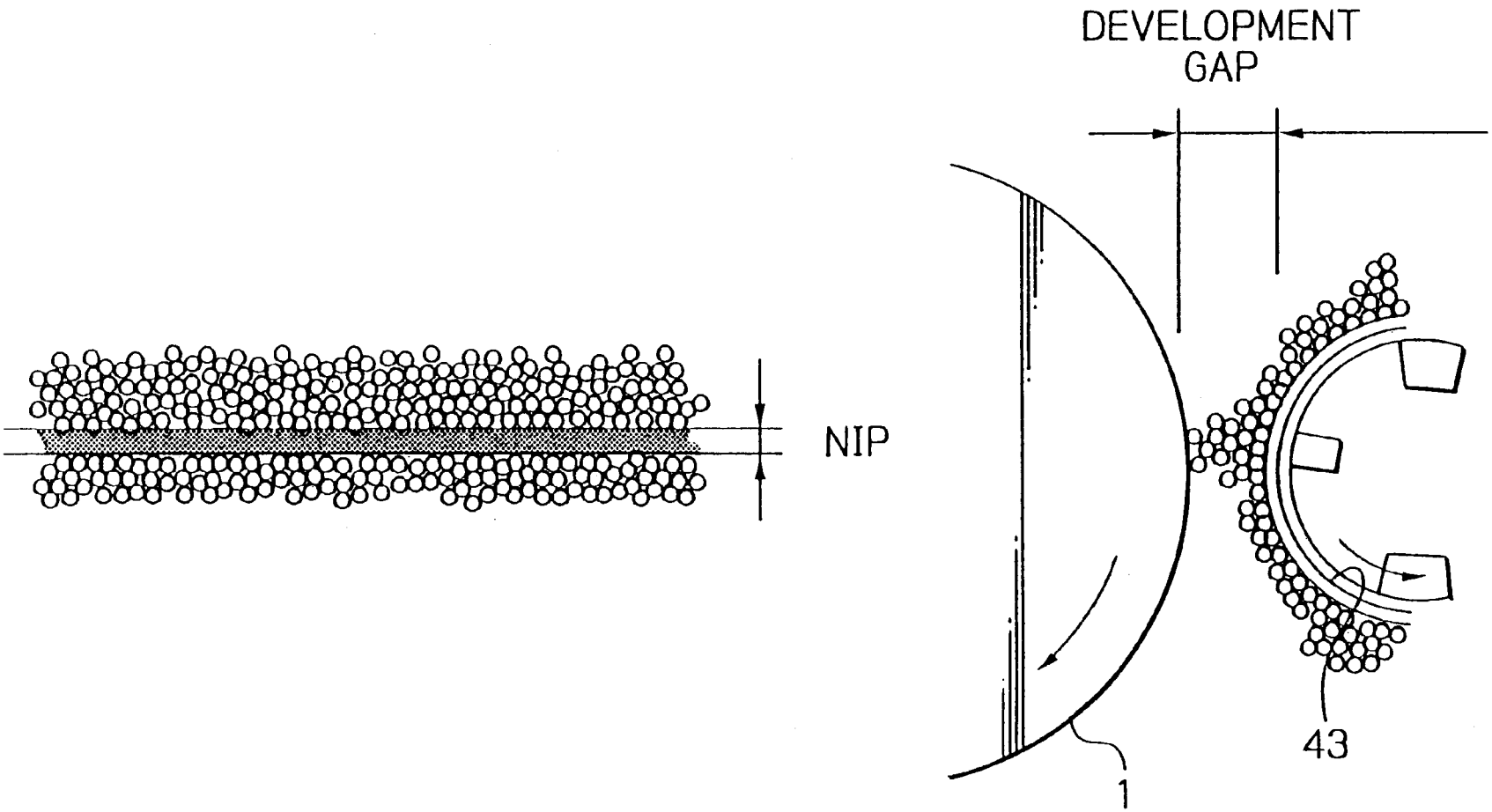
FIG. 18 is a view showing the size of the development gap and that of a nip.

So long as the magnet brush contacts the drum 1 under the above conditions, the nip is greater than or equal to the particle size of the developer, but smaller than or equal to 2 mm, obviating the omission of a trailing edge. In addition, even a horizontal thin line and a single dot or similar small image can be sufficiently formed. FIG. 18 shows a condition particular to this specific configuration. FIG. 18 is contrastive to FIG. 8.

When the root portion of the magnet brush where the brush starts rising under the action of the main magnet P1 is 2 mm wide or less, the nip for development can be 2 mm wide or less.

Why the illustrative embodiment increases image density will be described hereinafter. The magnet roller of the illustrative embodiment reduces the height of the magnet brush to be formed by the main pole P1*b* and reduces the nip width for development, as stated above. Therefore, when the sleeve 43 conveys the magnet brush via the main pole P1, the brush starts rising and moves away from the nip in a shorter period of time; the linear velocity ratio of the brush to the drum 1 was found higher at this position than at the other positions. As a result, the amount of developer to contact the drum 1 increases and increases image density. Moreover, the small nip width reduces the amount of developer to stay at a position immediately preceding the nip, thereby reducing countercharge. This prevents image density from decreasing and thereby enhances the developing ability of the developing device.

As stated above, even in the illustrative embodiment including only a single main pole, a sufficiently strong electric field can be formed at the boundary of the developing region as well. The magnet brush can therefore efficiently collect the toner left on the drum 1.

In the illustrative embodiment, the leveling member 7 located downstream of the image transfer position prevents the toner from locally gathering on the drum 1, as in the previous embodiment. This is also successful to achieve the advantages described in relation to the previous embodiment.

Figure 11:
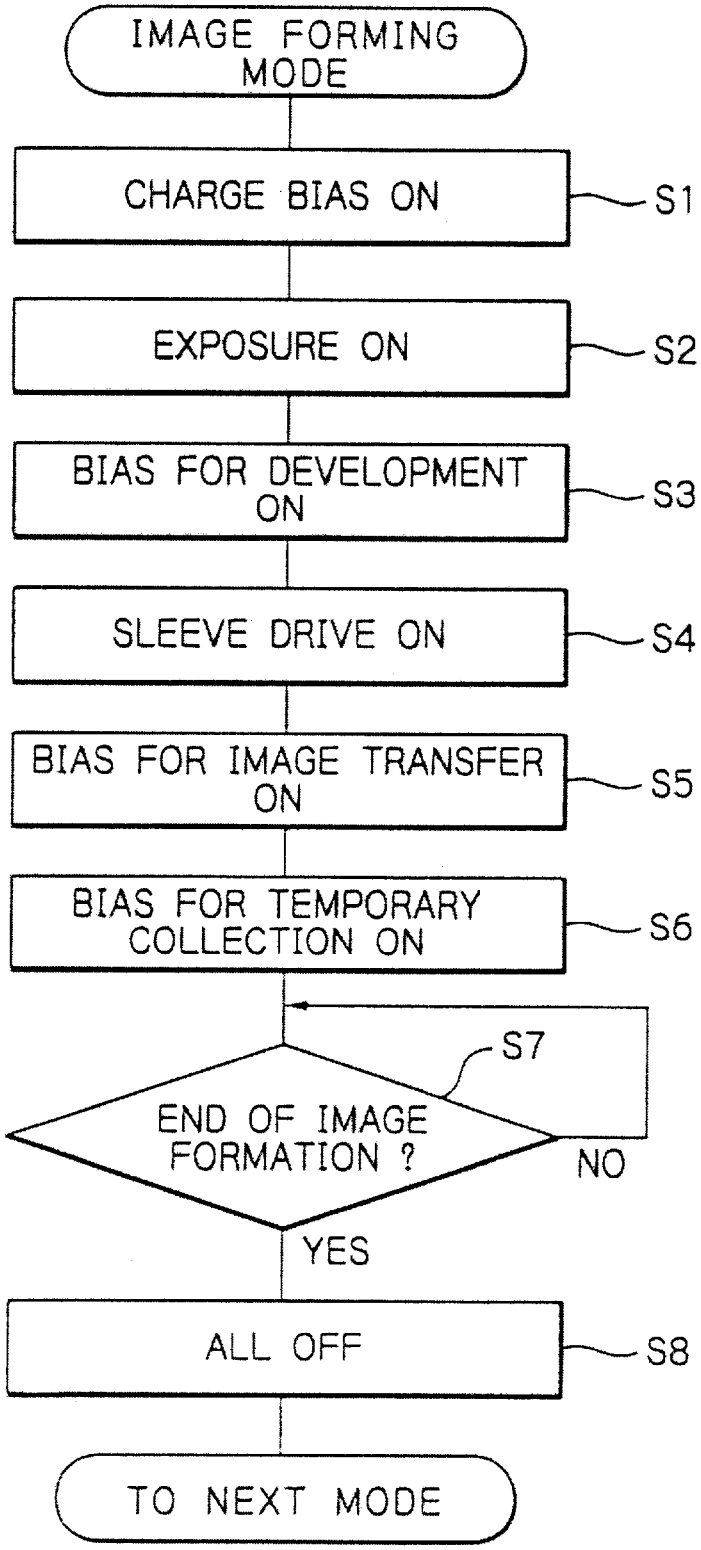
FIG. 11 is a flowchart demonstrating an image forming mode unique to the illustrative embodiment.

The illustrative embodiment may additionally include the temporary collection roller 10 located downstream of the image transfer position. The system for controlling the temporary collection roller 10 has been described with reference to FIGS. 11 through 13.

How the illustrative embodiment obviates the omission of a trailing edge, the defective reproduction of a horizontal line and irregular dots will be described hereinafter. When the development gap between the drum 1 and the sleeve 43 is great, various troubles occur because the edge effect is enhanced at the time of development. For example, solitary lines are thickened to an uncontrollable degree. Also, a portion around a high density portion is lost and left blank in an image. Further, solitary dots are reproduced in a size greater than the actual size, preventing tonality from being linearly reproduced on an area ratio basis. In addition, granularity is conspicuous in a halftone portion.

By reducing the development gap, it is possible to reduce the undesirable occurrence ascribable to the edge effect and therefore to output an attractive image desirable in uniformity and tonality. We experimentally found that when the gap was greater than the size of a string of ten carrier particles having a mean particle size, the edge effect was enhanced and made the various defects conspicuous.

For the experiments, use was made of a carrier implemented by a ferrite core coated with silicone rubber. Assuming a string of carrier particles, then electric resistance is determined by the total thickness of the coating layers and the number of points where the particles contact. A string of more than ten carrier particles increases substantial electric resistance and brings about the same situation as when the development gap is increased. This relation holds when the carrier particle size ranges from 30 $\mu$m to 60 $\mu$m, as determined by experiments.

Figure 19:
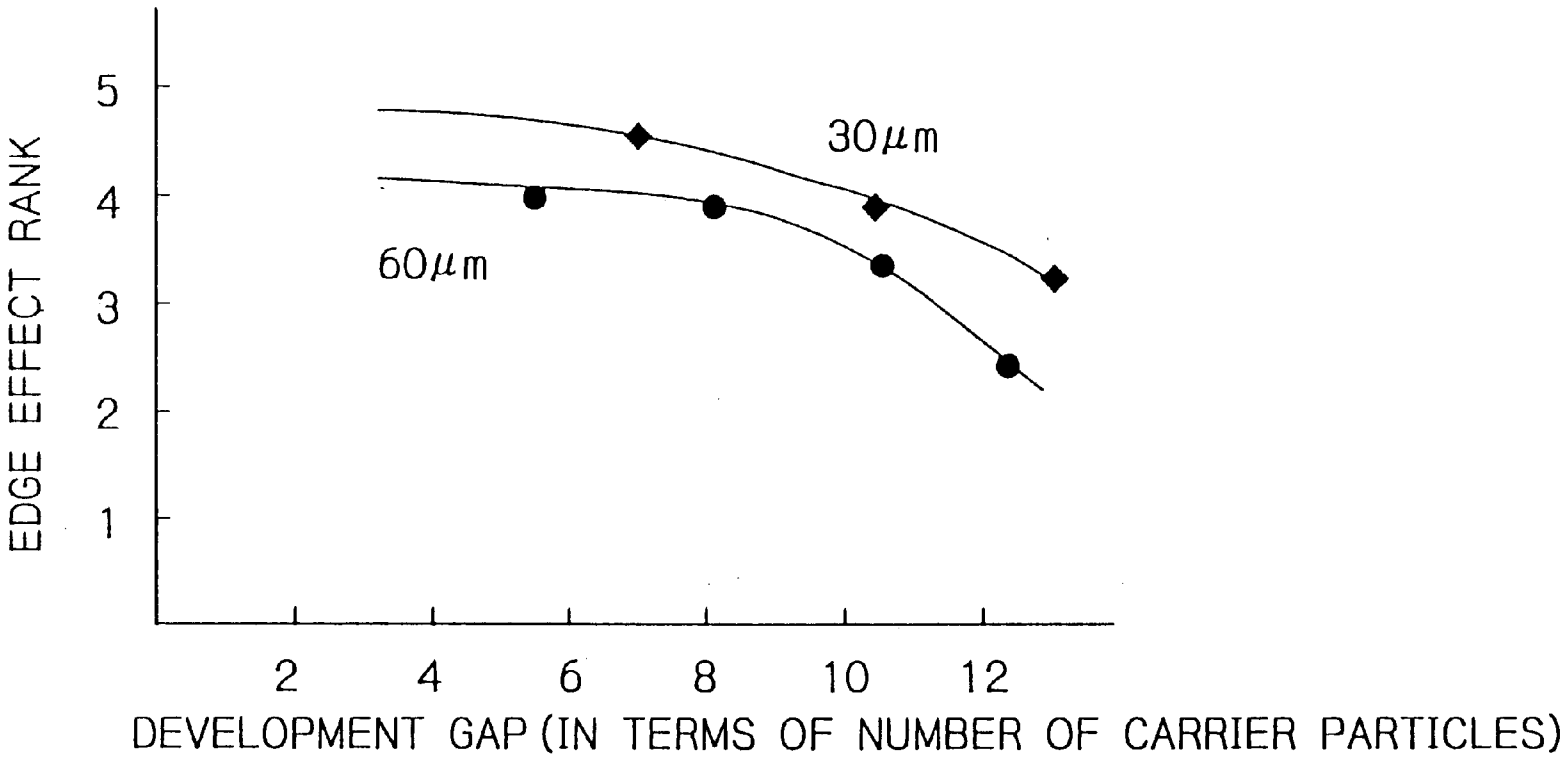
FIG. 19 is a graph showing a relation between the development gap and the edge effect.

FIG. 19 shows a relation between the development gap and the edge effect. In FIG. 19, the abscissa indicates a development gap in terms of the number of carrier particles while the ordinate indicates a rank determined by the organoleptic estimation; rank 1 shows that no edge effect was observed while rank 5 shows that the edge effect was most conspicuous. For the estimation, use was made of carrier particle sizes of 30 $\mu$m and 60 $\mu$m. As FIG. 19 indicates, the edge effect was enhanced without exception when the number of carrier particles exceeded ten.

On the other hand, assume that the development gap is sized to accommodate a string of less than three toner particles. Then, the gap obstructs the free movement of the carrier particles and thereby increases the frictional force of the magnet brush acting on the drum 1. The magnet brush is therefore likely to cause brush marks to appear in an image or to scratch the drum 1 and cause stripes to appear in an image. Moreover, such a magnet brush reduces the life of the drum 1.

A development gap greater than a string of three or more carrier particles, but smaller than a string of ten or less toner particles, has heretofore caused the trailing edge of an image to be lost or caused a horizontal line to be disconnected. This will be described specifically hereinafter. The toner moves between the magnet brush and the drum, developing a latent image. In the case of contact development, the toner moves mainly in the nip in which the drum 1 and magnet brush contact each other. This, however, causes the trailing edge of a solid image to be lost.

Figure 20:
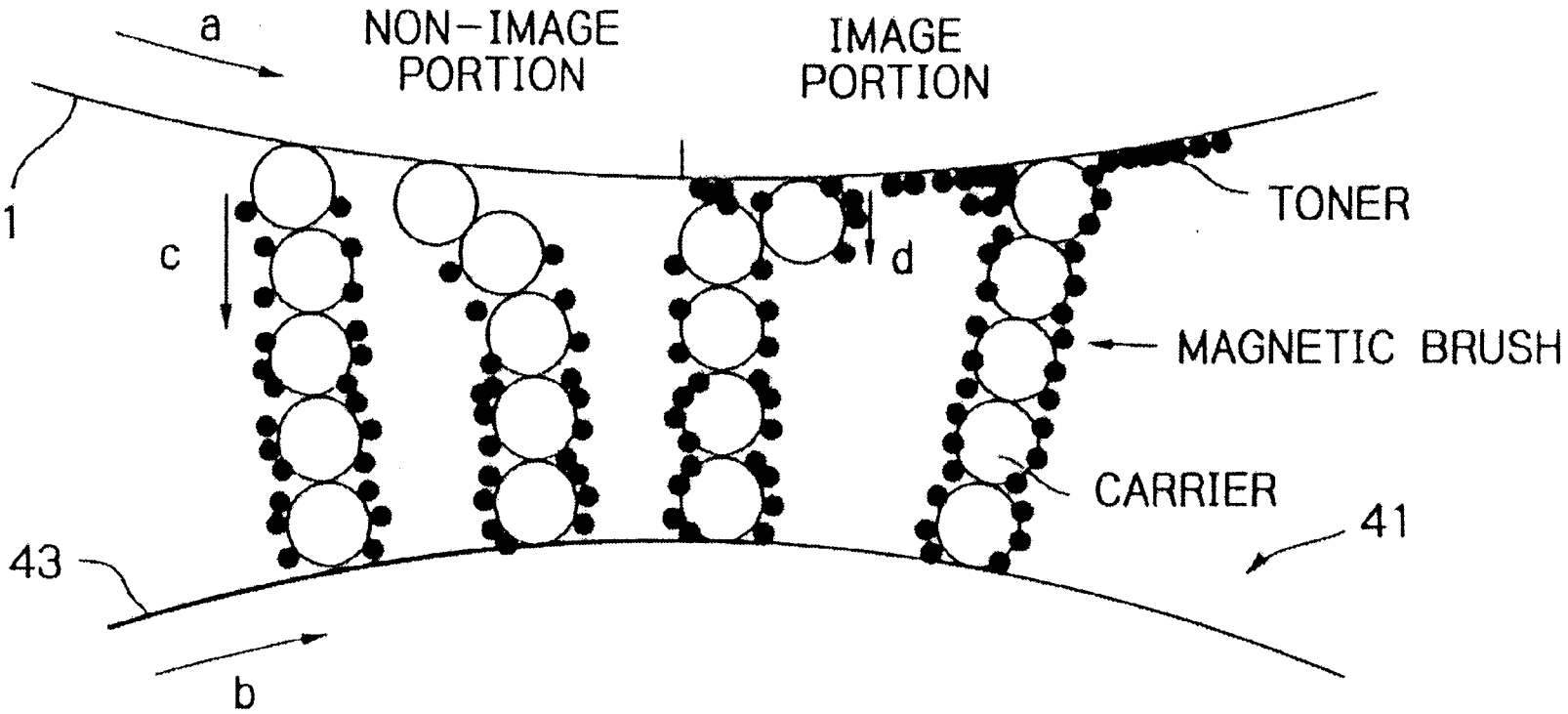
FIG. 20 is a view showing why the trailing edge of an image is lost.

The omission of a trailing edge will be described with reference to FIG. 20. As shown, the drum 1 and developing roller 41, or sleeve 43, rotate in directions a and b, respectively. The developing roller 41 moves at a higher linear velocity than the drum 1. The magnet brush therefore always develops a latent image formed on the drum 1, outrunning the latent image. When the magnet brush contacts the non-image portion or background of the drum 1, the electric field formed in the developing region exerts a force in a direction c, forcing the toner present at the tip of the magnet brush away from the drum 1. As a result, the longer the time during which the magnet brush remains in contact with the non-image portion, the lower the toner concentration around the drum 1.

The magnet brush moves toward the downstream side of the developing region in accordance with the movement of the developing roller 41 and catches up with the image portion of the drum 1. At this instant, the tip of the magnet brush low in toner concentration electrostatically attracts the toner deposited on the drum 1 in a direction d. Consequently, the toner present on the drum 1 decreases while the toner present at the tip of the magnet roller again increases. If the magnet brush restores the toner concentration, then it does not attract the toner away from the drum 1 even when further moved to the downstream side.

However, when the magnet brush remains in contact with the drum 1 only for a short period of time, the tip of the magnet brush low in toner concentration contacts the trailing edge of the image carried on the drum 1. Consequently, the amount of the toner forming the image decreases with the result that the trailing edge of the image passed the developing region appears blurred.

In the developing region or nip, the size of the electric field differs from the point where the drum 1 and sleeve 43 are closest to each other to the point where they are remotest from each other, i.e., the boundary of the nip. In the illustrative embodiment, the drum 1 has a diameter of 60 mm while the sleeve 43 has a diameter of 20 mm. Further, the gap between the drum 1 and the sleeve 43 is 0.4 mm while the nip width is 4 mm. In these conditions, the distance between the drum 1 and the sleeve 43 is 0.4 mm at the center of the nip and 0.67 mm at the boundary of the nip. Assuming that the developer layer has a uniform width, then the field strength at the center of the nip and the field strength at the boundary of the nip have a ratio of about 1:0.6. Therefore, at the downstream side of the nip, opposite charge deposited on the carrier around the drum 1 collects the toner more than the electric field causes the toner to deposit on the drum 1, resulting in the omission of a trailing edge.

By contrast, by reducing the nip width such that the gap ratio between the center and the boundary approaches 1, it is possible to prevent the field strength from decreasing even at the boundary of the nip. Therefore, the carrier substantially does not collect the toner present on the drum 1, so that the omission of a trailing edge is obviated. FIG. 21 shows the results of experiments conducted to confirm the above occurrence.

Figure 22:
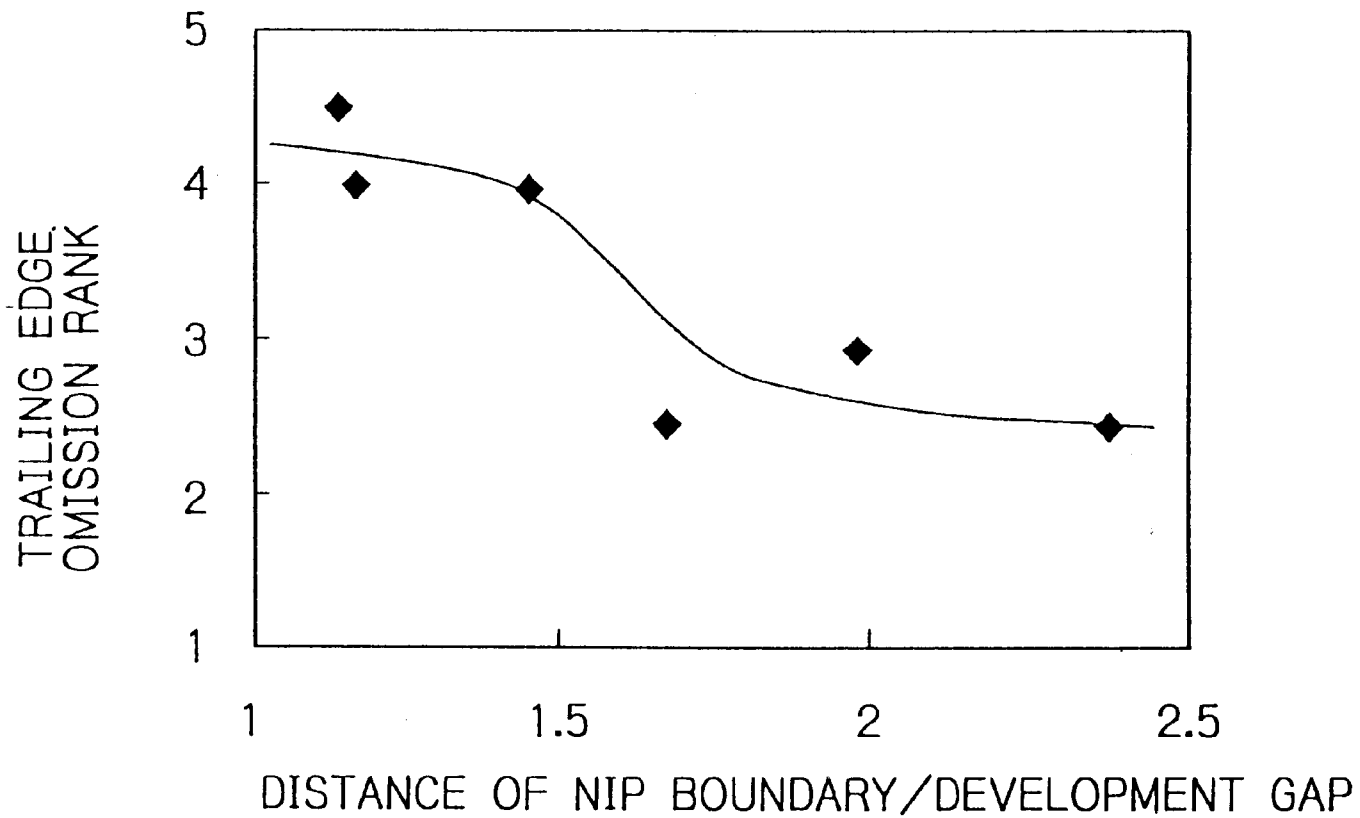
FIG. 22 is a graph showing a relation between a ratio of a distance at the boundary of a nip to the development gap and the omission of a trailing edge.

To measure the nip width, while the drum 1 and sleeve 43 were held stationary, a bias for causing the toner to migrate from the sleeve 43 toward the drum 1 was applied. In this condition, the range of the drum 1 over which the toner deposited on the drum 1 was measured as a nip. More specifically, the above bias was applied to the sleeve 43 for about 1 second without the drum 1 being charged. The drum 1 was then pulled out to measure the width over which the toner deposited on the drum 1 in the direction of movement of the drum 1. The boundary of the nip was determined by calculation using the drum diameter, sleeve diameter, development gap, and development nip. In any case, the ratio of the linear velocity of the sleeve 43 to that of the drum 1 was 2.5. FIG. 22 shows the results of measurement. In FIG. 22, the abscissa indicates a ratio of the distance between the drum 1 and the sleeve 43 at the boundary of the nip, i.e., the development gap to the distance between the same at the center of the nip. The ordinate indicates the rank of the omission level of a trailing edge observed by eye; rank 5 indicates that no omission was observed while rank 1 indicates that omission was most conspicuous.

As FIG. 22 indicates, the ratio in distance and the omission of a trailing edge are correlated, as expected. When the ratio in distance exceeds 1.5, the omission of a trailing edge is conspicuous and lowers image quality while aggravating the thinning of a horizontal line, rendering dots irregular and aggravating granularity. It follows that if the ratio in distance is 1.5 or below, then an image free from the omission of a trailing edge is attainable. By the same mechanism, there are insured the faithful reproduction of lines and stable reproduction of dots.

As stated above, in the illustrative embodiment, the half width of the magnetic flux of the main pole and therefore the development gap is reduced. Also, the ratio of the distance at the boundary of the nip to the development gap is selected to be 1.5 or below. Further, the development gap is so sized as to accommodate a string of three or more carrier particles, but accommodate a string of ten or Less carrier particles. With these conditions, the illustrative embodiment minimizes the disturbance to a toner image carried on the drum 1 ascribable to the magnet brush and reduces the edge effect. This successfully insures with the cleanerless process an image free from the omission of a trailing edge, desirable in the reproducibility of horizontal lines and the uniformity of dots, and low in granularity.

It is preferable that three or more carrier particles exist between the drum 1 and the sleeve 43. If only two or less particles exist between the drum 1 and the carrier 43, then the magnet disposed in the sleeve 43 exerts excessive restraint on the particles and thereby makes the magnet brush stiff. The stiff magnet brush would cause brush marks to appear in an image. On the other hand, the toner should preferably be transferred in a high ratio. For this purpose, an additive may be added to each toner particle whose circularity is 0.97 or above.

Figure 23:
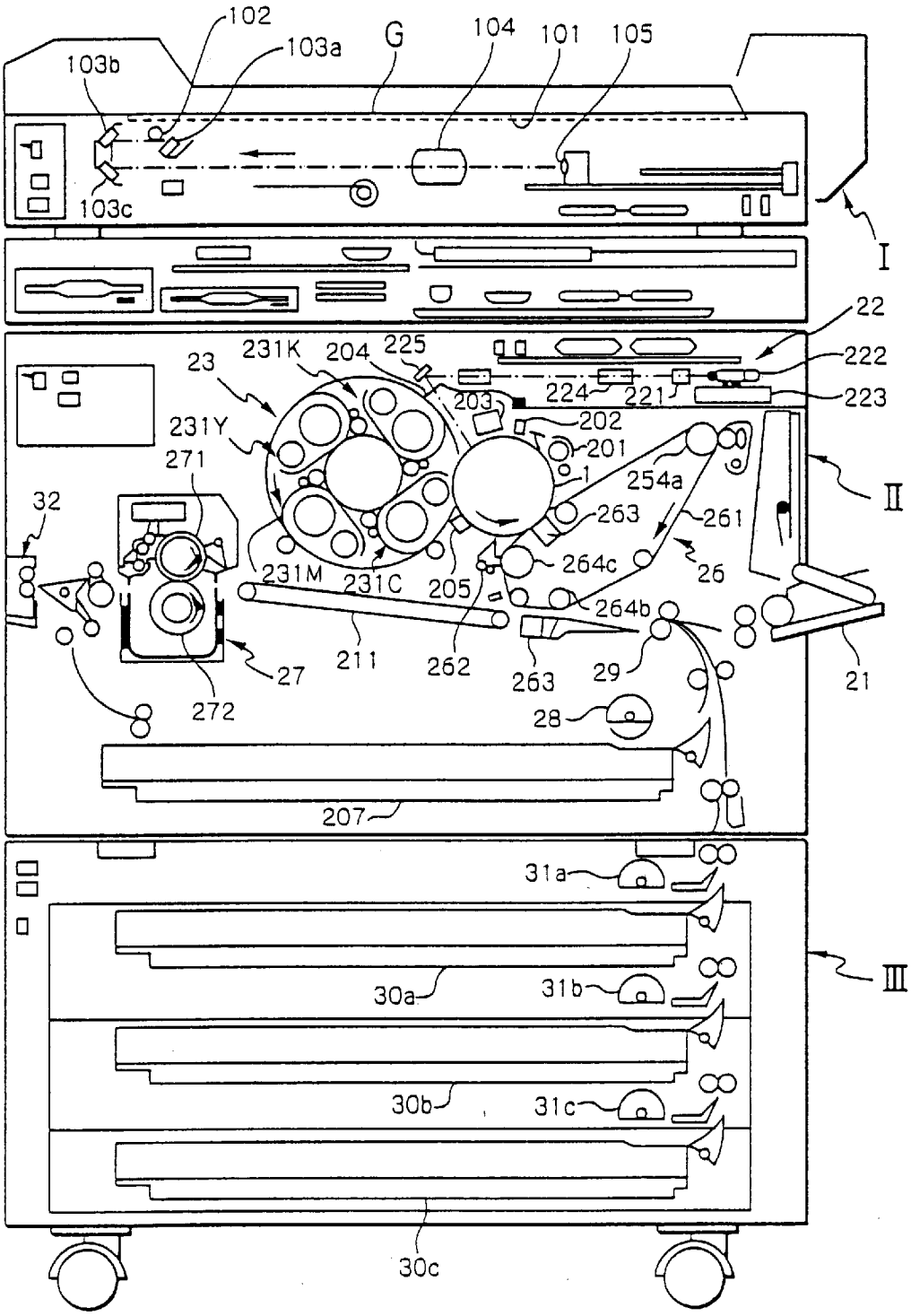
FIG. 23 is a view showing an image forming apparatus to which the present invention is applicable.

Reference will be made to FIG. 23 for describing an image forming apparatus to which the illustrative embodiment is applied and implemented as an electrophotographic color copier by way of example. As shown, the color copier includes a color scanner or image reading device I, a color printer or image recording device II, and a sheet bank III.

The color scanner I includes a lamp 102 for illuminating a document G laid on a glass platen 101. The resulting reflection from the document C is incident to a color image sensor 105 via mirrors 103*a*, 103*b* and 103*c* and a lens 104. The color image sensor 105 reads color image data representative of the document G color by color, e.g., red (R), green (G) and blue (B) while converting them to corresponding image signals. Specifically, the color image sensor 105 includes R, G and B color separating means and a CCD (Charge Coupled Device) or similar photoelectric transducer and reads three different color image data at the same time. An image processing section, not shown, transforms the color image signals to black (Bk), cyan (C) magenta (M) and yellow (Y) color image data on the basis of a signal level.

More specifically, in response to a scanner start signal synchronous to the operation of the color printer II, optics made up of the lamp 102 and mirrors 103*a* through 103*c* sequentially scans the document G to the left, as viewed in FIG. 53. The color scanner I outputs color data of one color every time the optics scans the document. By repeating such scanning four consecutive times, the color scanner I sequentially outputs color image data of four different colors. The color printer II forms a single toner image every time it receives the color image data of one color from the color scanner I. The color printer II transfers the resulting toner images of four different colors to an intermediate image transfer belt 261, which will be described later, one above the other, thereby, completing a full-color image.

The color printer II includes the drum 1, an optical writing unit 22, a revolver or developing device 23, an intermediate image transferring unit 26, and a fixing unit 27. The drum 1 is rotatable counterclockwise, as indicated by an arrow in FIG. 23. Arranged around the drum 1 are a drum cleaner 201, a discharge lamp 202, a charger 203, a potential sensor 204, one of developing units arranged in the revolver 23, a density sensor 205, and the intermediate image transfer belt 261 included in the intermediate image transferring unit 26.

The optical writing unit 22 transforms the color image data received from the color scanner I to an optical signal and scans the drum 1 in accordance with the optical signal, thereby forming a latent image on the drum 1. The writing unit 22 includes a semiconductor laser or light source 221, a laser driver, not shown, a polygonal mirror 222, a motor 223 for driving the mirror 222, an f/θ lens 224, and a mirror 225.

The revolver 23 includes a Bk developing unit 231K, a C developing unit 231C, a M developing unit 231M and a Y developing unit 231Y as well as a drive section for rotating the revolver 23 in a direction indicated by an arrow in FIG. 23. The developing units 231K through 231Y each are constructed in the same manner as the developing device 4 shown in FIGS. 1 and 2. Specifically, the developing units 231K through 231Y each include a developing sleeve rotatable with a magnet brush formed thereon contacting the surface of the drum 1 and a paddle rotatable to scoop up and agitate a developer. In each of the developing units 231K through 231Y, the toner of the developer is charged to negative polarity by being agitated together with a ferrite carrier. A negative DC voltage Vdc on which an AC voltage Vac is superposed is applied to the developing sleeve as a bias for development. The bias biases the developing sleeve to a preselected potential relative to a metallic core included in the drum 1.

While the copier is in a standby state, the revolver 23 is positioned such that the developing unit 231K is located at a developing position where it faces the drum 1. On the start of a copying operation, the color scanner I starts reading Bk color image data at preselected timing. The writing unit 22 starts forming a latent image on the drum 1 with a laser beam in accordance with the above color image data. Let this latent image be referred to as a Bk latent mage for convenience. This is also true with latent images corresponding to the other colors C, M and Y.

The Bk developing sleeve starts rotating before the leading edge of the Bk latent image arrives at the developing position. As a result, the Bk latent image is developed by Bk toner to become a Bk toner image. As soon as the trailing edge of the Bk latent image moves away from the developing position, the revolver 23 is rotated to locate the next developing unit (C developing unit) at the developing position. This rotation of the revolver 23 completes at least before the leading edge of a latent image derived from the next color data arrives at the developing position.

The intermediate image transferring unit 26 includes a belt cleaner 262 and a corona discharger 263 in addition to the intermediate image transfer belt 261. The belt 261 is passed over a drive roller 264*a*, a roller 264*b* assigned to image transfer, a roller 264*c* assigned to belt cleaning, and a plurality of driven rollers. A motor, not shown, drives the belt 261. The belt cleaner 262 includes an inlet seal, a rubber blade, a discharge coil, and a mechanism for moving the inlet seal and a rubber blade. While toner images of the second, third and fourth colors are sequentially transferred from the drum to the belt 261 after a toner image of the first color, the above mechanism maintains the inlet seal and rubber blade spaced from the belt 261. The corona discharger 263 applies either a DC voltage or an AC-biased DC voltage to the belt 261 by corona discharge, causing a full-color image to be transferred from the belt 261 to a paper sheet or similar recording medium.

The color printer II additionally includes a sheet cassette 207 in addition to the previously mentioned sheet bank III. The sheet bank III includes sheet cassettes 30*a*, 30*b* and 30*c* each being loaded with a stack of paper sheets of particular size. Pickup rollers 28, 31*a*, 31*b* and 31*c* are associated with the sheet cassettes 207, 30*a*, 30*b* and 30*c*, respectively. Paper sheets are sequentially fed from designated one of the paper cassettes 207 and 31*a* through 31*c* by associated one of the pickup rollers 28 and 31 through 31*c* to a registration roller pair 29. If desired, an OHP (OverHedad Projector) sheet, a relatively thick sheet or similar special sheet may be fed by hand from a manual feed tray 21.

On the start of an image forming cycle, the drum 1 is caused to start rotating counterclockwise by the motor. Likewise, the belt 261 is caused to start turning clockwise by the motor. A Bk toner image, a C toner image, a M toner image and a Y toner image are sequentially formed while the belt 261 is in rotation, and sequentially transferred to the belt 261 one above the other, completing a full-color image.

More specifically, the charger 203 uniformly charges the surface of the drum 1 to about −700 V by corona discharge. The semiconductor laser 221 scans the charged surface of the drum 1 by raster scanning in accordance with Bk color image data. As a result, the scanned or exposed portion of the drum 1 looses its charge in proportion to the quantity of incident light, so that a Bk latent image is formed. Bk toner deposited on the Bk developing sleeve contacts the Bk latent image and deposits only on the exposed portion of the drum 1, thereby forming a corresponding Bk toner image. A belt transfer unit 265 transfers the Bk toner image from the drum 1 to the belt 261, which is turning at the same speed as the drum 1 in contact with the drum 1 (primary image transfer).

The drum cleaner 201 removes some toner left on the drum 1 after the primary image transfer. The toner collected by the drum cleaner 201 is stored in a waste toner tank via a piping although not shown specifically.

After the formation and transfer of the Bk toner image, the color scanner I starts reading C image data at preselected timing. The laser 221 forms a C latent image on the drum 1 in accordance with the C image data. After the passage of the trailing edge of the Bk latent image, but before the arrival of the leading edge of the C latent image, the revolve 23 brings the developing unit 231C to the developing position. The developing unit 231C develops the C latent image with C toner for thereby forming a C toner image. After the trailing edge of the C latent image has moved away from the developing position, the revolver 23 is again rotated to bring the developing unit 231M to the developing position. This rotation also completes before the leading edge of a M latent image arrives at the developing position. The procedure described above is repeated with M and Y color image data to thereby form a M and a Y toner image.

The B, C, M and Y toner images sequentially transferred from the drum 1 to the belt 261 one above the other, i.e., a full-color image is transferred to a paper sheet by the corona discharger 263.

The paper sheet is fed from any one of the sheet cassettes and manual feed tray when the above-described image forming operation begins, and is waiting at the nip of the registration roller pair 29. The registration roller pair 29 conveys the paper sheet such that the leading edge of the paper sheet meets the leading edge of the toner image conveyed by the belt 261 to the corona discharger 263. The corona discharger 263 charges the paper sheet to positive polarity by corona discharge, thereby transferring the toner image from the belt 261 to the paper sheet (secondary image transfer). Subsequently, an AC+DC corona discharger, not shown, located at the left-hand side of the corona discharger 263, as viewed in FIG. 53, discharges the paper sheet to thereby separate it from the belt 261.

A belt 211 conveys the paper sheet carrying the toner image thereon to the fixing unit 27. In the fixing unit 27, a heat roller 271 and a press roller 272 fix the toner image on the paper sheet with heat and pressure. An outlet roller pair 32 drives the paper sheet coming out of the fixing unit 27 out of the apparatus. The paper sheet or copy is stacked on a copy tray, not shown, face up.

After the secondary image transfer, the drum cleaner 201 cleans the surface of the drum 1 with the brush roller and rubber blade. Subsequently, the discharge lamp 202 discharges the surface of the drum 1. At the same time, the previously mentioned mechanism again presses the blade of the belt cleaner 262 against the surface of the belt 261 to thereby clean it.

In summary, it will be seen that the present invention provides a developing device for an image forming apparatus having various unprecedented advantages, as enumerated below.

(1) A magnet brush formed on a developer carrier efficiently collects toner left on an image carrier after image transfer. An image free from the omission of a trailing edge, the defective reproduction of a horizontal line, irregular dots and granularity is achievable with a cleanerless process.

(2) The flux density distribution of a main pole for development can have the half value of its flux density easily reduced by a simple configuration. This enhances efficient toner collection and image quality.

(3) A strong electric field that attracts the toner toward a developing device can be formed between the image carrier and the developer carrier, further enhancing efficient toner collection.

(4) It is possible to collect the toner deposited on the image carrier upstream of a developing region while developing a latent image. Therefore, development and toner collection can be effected at the same time, increasing the efficiency of an image forming process.

(5) The toner left on the image carrier is scattered, or distributed, to enhance efficient toner collection at a developing position. This obviates a residual image ascribable to defective toner collection.

(6) Irregular screening is obviated during exposure, so that a latent image can be formed in an adequate manner. Also, the toner can be collected more efficiently at the developing position. It follows that a residual image ascribable to defective toner collection is obviated.

Various modifications will become possible for those skilled in the art after receiving the teachings of the present disclosure without departing from the scope thereof.

What is claimed is:

1. In a developing method for scooping up a developer to a developer carrier, causing said developer to form a magnet brush on said developer carrier, and causing said magnet brush to contact an image carrier to thereby develop a latent image formed on said image carrier, a ratio of a distance between said image carrier and said developer carrier at a boundary of a nip to a distance between said image carrier and said developer carrier at a position where said image carrier and said developer carrier are closest to each other is 1.5 or less, and the magnet brush formed on the developer carrier collects toner, which is included in the developer, deposited on the image carrier.

2. In a developing device comprising a developer carrier to which a developer is scooped up, and causing a magnet brush formed on said developer carrier to contact an image carrier to thereby develop a latent image formed on said image carrier, a ratio of a distance between said image carrier and said developer carrier at a boundary of a nip to a distance between said image carrier and said developer carrier at a position where said image carrier and said developer carrier are closest to each other is 1.5 or less, and the magnet brush formed on the developer carrier collects toner, which is included in the developer, deposited on the image carrier.

3. The developing device as claimed in claim 2, wherein a magnet roller is disposed in said developer carrier and includes a main pole for development and an auxiliary pole that helps said main pole exert a magnetic force.

4. The developing device as claimed in claim 3, wherein an electric field is formed between said image carrier and said developer carrier for collecting the toner deposited on said image carrier.

5. The developing device as claimed in claim 4, wherein said developing device collects the toner existing in a portion of said image carrier upstream of a developing region while developing a latent image formed on said image carrier.

6. The developing device as claimed in claim 5, wherein leveling means is provided for scattering the toner left on said image carrier after image transfer on said image carrier.

7. The developing device as claimed in claim 5, wherein temporary collecting means is provided for temporarily collecting the toner left on said image carrier after image transfer, or causing said toner to temporarily stay, and then causing said toner to again deposit on said image carrier.

8. The developing device as claimed in claim 2, wherein a magnet roller is disposed in said developer carrier and includes a main pole for development formed by one of a plurality of magnets, which constitute said magnet roller, having a smallest half value of a flux density.

9. The developing device as claimed in claim 8, wherein an electric field is formed between said image carrier and said developer carrier for collecting the toner deposited on said image carrier.

10. The developing device as claimed in claim 9, wherein said developing device collects the toner existing in a portion of said image carrier upstream of a developing region while developing a latent image formed on said image carrier.

11. The developing device as claimed in claim 10, wherein leveling means is provided for scattering the toner left on said image carrier after image transfer on said image carrier.

12. The developing device as claimed in claim 10, wherein temporary collecting means is provided for temporarily collecting the toner left on said image carrier after image transfer, or causing said toner to temporarily stay, and then causing said toner to again deposit on said image carrier.

13. The developing device as claimed in claim 2, wherein an electric field is formed between said image carrier and said developer carrier for collecting the toner deposited on said image carrier.

14. The developing device as claimed in claim 13, wherein said developing device collects the toner existing in a portion of said image carrier upstream of a developing region while developing a latent image formed on said image carrier.

15. The developing device as claimed in claim 14, wherein leveling means is provided for scattering the toner left on said image carrier after image transfer on said image carrier.

16. The developing device as claimed in claim 14, wherein temporary collecting means is provided for temporarily collecting the toner left on said image carrier after image transfer, or causing said toner to temporarily stay, and then causing said toner to again deposit on said image carrier.

17. The developing device as claimed in claim 2 wherein said developing device collects the toner existing in a portion of said image carrier upstream of a developing region while developing a latent image formed on said image carrier.

18. The developing device as claimed in claim 17, wherein leveling means is provided for scattering the toner left on said image carrier after image transfer on said image carrier.

19. The developing device as claimed in claim 17, wherein temporary collecting means is provided for temporarily collecting the toner left on said image carrier after image transfer, or causing said toner to temporarily stay, and then causing said toner to again deposit on said image carrier.

20. The developing device as claimed in claim 2, wherein leveling means is provided for scattering the toner left on said image carrier after image transfer on said image carrier.

21. The developing device as claimed in claim 2, wherein temporary collecting means is provided for temporarily collecting the toner left on said image carrier after image transfer, or causing said toner to temporarily stay, and then causing said toner to again deposit on said image carrier.

22. An image forming apparatus including a developing device comprising a developer carrier to which a developer is scooped up, and causing a magnet brush formed on said developer carrier to contact an image carrier to thereby develop a latent image formed on said image carrier, wherein a ratio of a distance between said image carrier and said developer carrier at a boundary of a nip to a distance between said image carrier and said developer carrier at a position where said image carrier and said developer carrier are closest to each other is 1.5 or less, and the magnet brush formed on the developer carrier collects toner, which is included in the developer, deposited on the image carrier.

* * * * *